US011472651B2

(12) United States Patent
Murata

(10) Patent No.: US 11,472,651 B2
(45) Date of Patent: Oct. 18, 2022

(54) DOCUMENT CONVEYING DEVICE AND METHOD OF CONTROLLING A DOCUMENT CONVEYING DEVICE

(71) Applicant: KYOCERA Document Solutions Inc., Osaka (JP)

(72) Inventor: Takuro Murata, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 59 days.

(21) Appl. No.: 17/308,263

(22) Filed: May 5, 2021

(65) Prior Publication Data

US 2021/0347590 A1 Nov. 11, 2021

(30) Foreign Application Priority Data

May 11, 2020 (JP) ..... JP2020-083067
Mar. 30, 2021 (JP) ..... JP2021-057376

(51) Int. Cl.

| | |
|---|---|
| ***B65H 7/18*** | (2006.01) |
| ***B65H 9/00*** | (2006.01) |
| ***B65H 5/06*** | (2006.01) |
| ***B65H 7/08*** | (2006.01) |
| ***B65H 3/06*** | (2006.01) |

(52) U.S. Cl.

CPC ..... *B65H 7/18* (2013.01); *B65H 3/06* (2013.01); *B65H 5/062* (2013.01); *B65H 7/08* (2013.01); *B65H 9/002* (2013.01); *B65H 2301/331* (2013.01); *B65H 2511/24* (2013.01); *B65H 2513/10* (2013.01); *B65H 2513/20* (2013.01); *B65H 2513/512* (2013.01); *B65H 2701/1311* (2013.01); *B65H 2801/06* (2013.01)

(58) Field of Classification Search

CPC . B65H 1/04; B65H 3/06; B65H 5/062; B65H 7/00; B65H 7/02; B65H 7/04; B65H 7/08; B65H 7/18; B65H 9/002; B65H 2513/10; B65H 2513/20; B65H 2513/512

See application file for complete search history.

(56) References Cited

U.S. PATENT DOCUMENTS

| | | | | |
|---|---|---|---|---|
| 2015/0021846 | A1* | 1/2015 | Lee | B65H 3/06 271/229 |
| 2017/0166411 | A1* | 6/2017 | Kawarago | B65H 3/5261 |
| 2019/0023513 | A1* | 1/2019 | Hirano | B65H 3/06 |
| 2021/0362519 | A1* | 11/2021 | Hur | B41J 13/0018 |

FOREIGN PATENT DOCUMENTS

JP 2019-81623 A 5/2019

* cited by examiner

*Primary Examiner* — Prasad V Gokhale
(74) *Attorney, Agent, or Firm* — Stein IP, LLC

(57) ABSTRACT

A document conveying device includes a document tray, a first rotary member, a first motor, a second rotary member, a second motor, a document feed sensor, and a controller. The controller counts a counted time from the time point that the first motor starts to rotate until the leading end of a document reaches the document feed sensor. When the time resulting from subtracting the counted time from a required sheet-to-sheet time interval is longer than the required speed change time, the controller performs deceleration and post-deceleration acceleration for the first motor. The required speed change time is the time required for speed change from the first rotation speed to the second rotation speed.

16 Claims, 10 Drawing Sheets

FIG.5

D1

| | PRIMARY SHEET FEEDING | SECOND CONVEYANCE SPEED(V2) | | | |
|---|---|---|---|---|---|
| | | COLOR 300dpi | MONO-CHROME, 300dpi | COLOR 600dpi | MONO-CHROME, 600dpi |
| 1ST ROTARY MEMBER (1ST MOTOR) | 1ST CONVEYANCE SPEED | 1ST SPEED | 1ST SPEED | 2ND SPEED | 3RD SPEED |
| 2ND ROTARY MEMBER (2ND MOTOR) | – | 1ST SPEED | 1ST SPEED | 2ND SPEED | 3RD SPEED |
| PAIRS OF DOCUMENT CONVEYING ROLLERS (DOCUMENT CONVEYING MOTOR) | – | 1ST SPEED | 1ST SPEED | 2ND SPEED | 3RD SPEED |
| PAIR OF DOCUMENT DISCHARGE ROLLERS (DOCUMENT DISCHARGE MOTOR) | – | 1ST SPEED | 1ST SPEED | 2ND SPEED | 3RD SPEED |

N.B. 1ST SPEED > 1ST CONVEYANCE SPEED > 3RD SPEED > 2ND SPEED (DESIRED SHEET-TO-SHEET TIME INTERVAL-T0≦T1)

(DESIRED SHEET-TO-SHEET TIME INTERVAL-T0>T1)

(DESIRED SHEET-TO-SHEET TIME INTERVAL-T0≦T1+T2+T3)

T4=(DESIRED SHEET-TO-SHEET TIME INTERVAL-T0-T1)/2

(DESIRED SHEET-TO-SHEET TIME INTERVAL-T0>T1+T2+T3)

T5=(DESIRED SHEET-TO-SHEET TIME INTERVAL-T0-T2-T3-T1)

T6=(DESIRED SHEET-TO-SHEET TIME INTERVAL-T0-T7-T3-T1)

(DESIRED SHEET-TO-SHEET TIME INTERVAL-T0≦T1)

(DESIRED SHEET-TO-SHEET TIME INTERVAL-T0>T1)

(DESIRED SHEET-TO-SHEET TIME INTERVAL-T0≦T1+T8+T9)

T10=(DESIRED SHEET-TO-SHEET TIME INTERVAL-T0-T1)/2

(DESIRED SHEET-TO-SHEET TIME INTERVAL-T0>T1+T8+T9)

T11=(DESIRED SHEET-TO-SHEET TIME INTERVAL-T0-T1-T8-T9)

T12=(DESIRED SHEET-TO-SHEET TIME INTERVAL-T0-T13-T9)

DOCUMENT CONVEYING DEVICE AND METHOD OF CONTROLLING A DOCUMENT CONVEYING DEVICE

INCORPORATION BY REFERENCE

This application is based on and claims the benefit of Japanese Patent Application No. 2020-083067 filed on May 11, 2020 and Japanese Patent Application No. 2021-057376 filed on Mar. 30, 2021, the contents of which are hereby incorporated by reference.

BACKGROUND

The present disclosure relates to a document conveying device that conveys a document toward a reading position.

Apparatuses that convey a sheet and perform a job are known. Such apparatuses include, for example, image forming apparatuses. A conveyed sheet may skew (suffer skewing). For example, if a sheet conveyed in an image forming apparatus skews, the printed image skews. Generally, a sheet is often thrust against a roller called a registration roller to correct a skew (skewed feeding). On the other hand, in some apparatuses, a sheet is intentionally not thrust against a roller. A known technology of not thrusting a sheet against a registration roller will be described below.

Specifically, a known image forming apparatus includes a transfer portion that transfer an image to a sheet, a registration roller that is provided upstream of the transfer portion in the sheet conveying direction, and a controller that controls the operation of the registration roller. The controller performs registrationless operation that does not involve thrusting the leading end of a sheet in the conveying direction against the registration roller, and then controls the swinging of the registration roller so that an image will be transferred in the right position in the sheet conveying direction. The controller performs either registrationless operation or registration operation in accordance with the shape of a sheet. The registration roller is swung in the direction perpendicular to the sheet conveying direction.

An image sensor is often used to read a document to obtain the image data of the document. For example, an apparatus provided with a copying function reads a document to generate image data and performs printing based on the generated image data.

Also often used is a document conveying device that continuously and automatically feeds one document after another toward a reading position. Using such a document conveying device allows continuous reading of a plurality of documents. A conveyed document may skew. In that case, the image in the image data obtained by reading skews. To cope with that, generally, a document conveying device includes a pair of registration rollers. In such a document conveying device, the leading end of a document is thrust against the pair of registration rollers at rest. This permits the leading end of the document to lie along the nip between the pair of registration rollers. Thus the skewing of the document is corrected. After skew correction, the pair of registration rollers starts to be rotated, so that the document with no skew is fed out.

Using a pair of registration rollers has also the advantage of making it easy to keep constant intervals between documents (sheet-to-sheet intervals). For example, the pair of registration rollers starts to be rotated at constant time intervals. For example, in a case where 30 documents are fed per minute, the pair of registration rollers starts to be rotated every two seconds. Feeding documents out at constant intervals prevents too short a sheet-to-sheet interval.

Not thrusting documents against the pair of registration rollers (not stopping documents at the pair of registration rollers) may result in too short a sheet-to-sheet interval. Specifically, a preceding document may drag the subsequent document to cause the subsequent document to protrude downstream in the conveying direction. How easily a document tends to protrude downstream depends on the paper quality of the document and how the document is set. If a subsequent document protrudes downstream in the conveying direction, it has a shorter interval from the preceding document. When documents are not stopped at the pair of registration rollers, the sheet-to-sheet interval is not adjusted. Thus not stopping documents at the pair of registration rollers may make it impossible to keep an adequate sheet-to-sheet interval.

The image forming apparatus mentioned above cannot cope with a subsequent sheet being drawn by the preceding sheet. The image forming apparatus mentioned above cannot control the sheet-to-sheet interval, often resulting in too short a sheet-to-sheet interval.

SUMMARY

According to one aspect of the present disclosure, a document conveying device includes a document tray, a first rotary member, a first motor, a second rotary member, a second motor, a document feed sensor, and a controller. On the document tray, a plurality of documents can be set. The first rotary member feeds one document after another out of the documents set on the document tray. The first motor rotates the first rotary member. The second rotary member is provided downstream of the first rotary member in a document conveying direction, and feeds the document toward a reading position. The second motor rotates the second rotary member to make it convey the document at a previously determined second conveyance speed. The document feed sensor is provided downstream of the first rotary member in the document conveying direction, upstream of the second rotary member in the document conveying direction. The controller recognizes, based on the output of the document feed sensor, the leading end of the document reaching the document feed sensor and the trailing end of the document leaving the document feed sensor. When the document starts to be conveyed, the controller starts to rotate the first motor. After the first motor starts to rotate until the leading end of the document reaches the document feed sensor, the controller rotates the first motor at a speed equal to or lower than a first rotation speed for conveying the document at a speed equal to or lower than a previously determined first conveyance speed. After the leading end of the document reaches the document feed sensor until the trailing end of the document leaves the document feed sensor, the controller changes the rotation speed of the first motor to a second rotation speed for conveying the document at the second conveyance speed. After the rotation speed of the first motor reaches the second rotation speed until the subsequent one of the documents starts to be fed, the controller stops the first motor. The controller counts as a counted time the time from the time point of the start of rotation of the first motor until the leading end of the document reaches the document feed sensor. When a time resulting from subtracting the counted time from a previously determined required sheet-to-sheet time interval is longer than a required speed change time, the controller performs deceleration and post-deceleration acceleration for the first motor to adjust the sheet-to-sheet interval between the document being fed and the preceding document. The required speed change time is the time required for speed change from the first rotation speed to the second rotation speed.

According to another aspect of the present disclosure, a method of controlling a document conveying device includes: setting a plurality of documents on a document tray; feeding, with a first rotary member, one document after another out of the documents set on the document tray; rotating, with a first motor, the first rotary member; feeding, with a second rotary member provided downstream of the first rotary member in a document conveying direction, the document toward a reading position; rotating, with a second motor, the second rotary member so that the second rotary member conveys the document at a previously determined second conveyance speed; providing a document feed sensor downstream of the first rotary member in the document conveying direction, upstream of the second rotary member in the document conveying direction; recognizing, based on an output of the document feed sensor, the leading end of the document reaching the document feed sensor and the trailing end of the document leaving the document feed sensor; starting, when the document starts to be conveyed, to rotate the first motor; rotating, after the first motor starts to rotate until the leading end of the document reaches the document feed sensor, the first motor at a speed equal to or lower than a first rotation speed for conveying the document at a speed equal to or lower than a previously determined first conveyance speed; changing, after the leading end of the document reaches the document feed sensor until the trailing end of the document leaves the document feed sensor, the rotation speed of the first motor to a second rotation speed for conveying the document at the second conveyance speed; stopping, after the rotation speed of the first motor reaches the second rotation speed until the subsequent one of the documents starts to be fed, the first motor; counting as a counted time the time from the time point of the start of rotation of the first motor until the leading end of the document reaches the document feed sensor; performing, when the time resulting from subtracting the counted time from a previously determined required sheet-to-sheet time interval is longer than a required speed change time, deceleration and post-deceleration acceleration for the first motor to adjust the sheet-to-sheet interval between the document being fed and the preceding document; and the required speed change time being the time required for speed change from the first rotation speed to the second rotation speed.

This and other objects of the present disclosure, and the specific benefits obtained according to the present disclosure, will become apparent from the description of embodiments which follows.

BRIEF DESCRIPTION OF THE DRAWINGS

FIG. 5 is a diagram showing one example of second conveyance speed definition data according to the embodiment;

DETAILED DESCRIPTION

In a document conveying device according to the present disclosure, an adequate sheet-to-sheet interval (interval between documents D) can be kept without documents D being thrust against a pair of registration rollers and hence without documents D being stopped at the pair of registration rollers. Hereinafter, an embodiment of the present disclosure will be described with reference to FIGS. 1 to 14. The following description deals with a multifunction peripheral 100 as an example of a document conveying device. The multifunction peripheral 100 is also an image forming apparatus. Specifically, the multifunction peripheral 100 conveys a document D that is set. The multifunction peripheral 100 reads the conveyed document D to generate image data. Based on the generated image data, the multifunction peripheral 100 can perform a print job and a transmission job. It should however be noted that the features in terms of structure, arrangement, etc. specifically described in connection with the embodiment are all merely illustrative, and are in no way meant to limit the scope of the present disclosure.

(Outline of Multifunction Peripheral 100)

Figure 1:
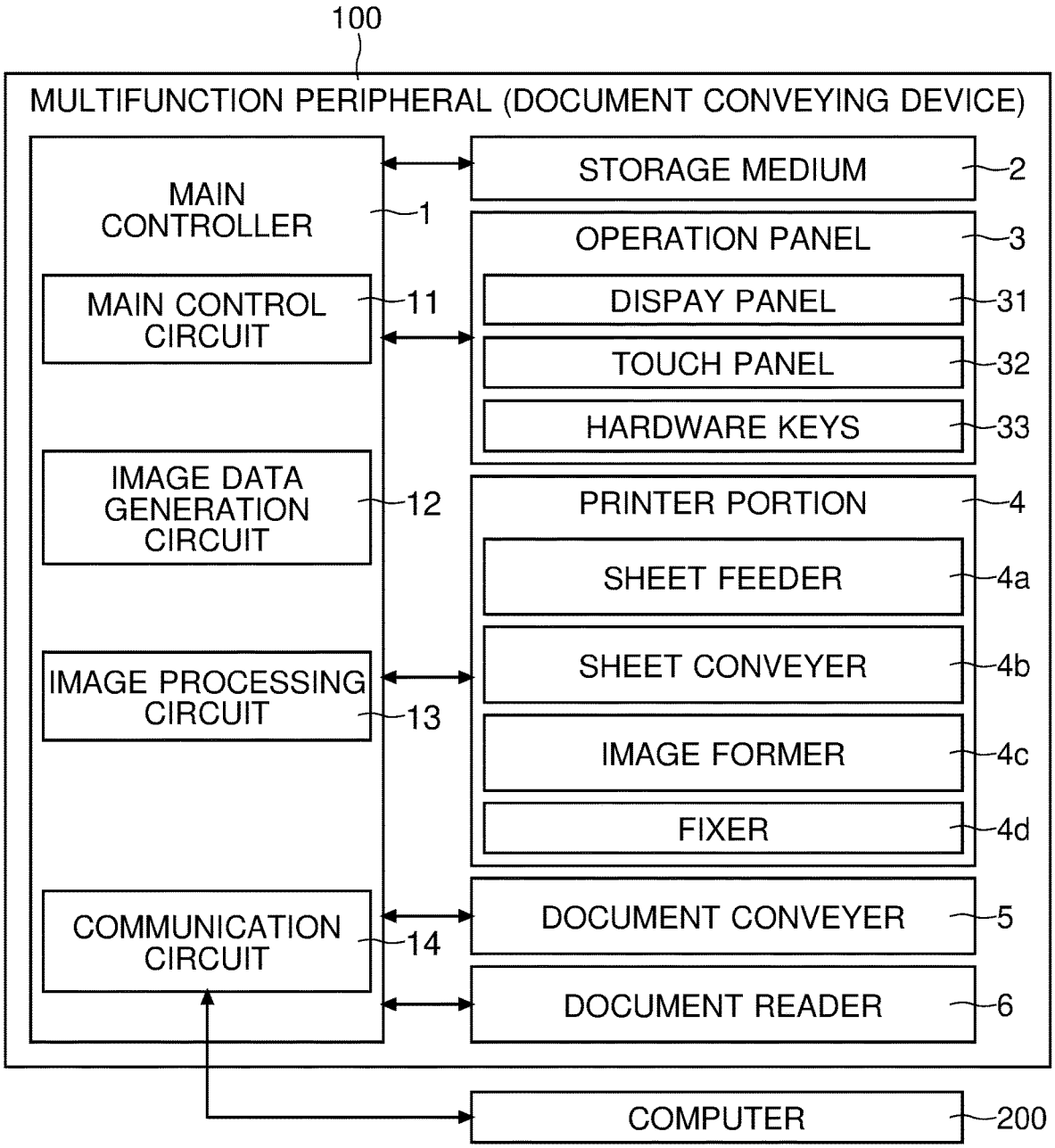
FIG. 1 is a diagram showing a multifunction peripheral according to an embodiment.

First, with reference to FIG. 1, the multifunction peripheral 100 according to the embodiment will be described in outline. As shown in FIG. 1, the multifunction peripheral 100 includes a main controller 1, a storage medium 2, an operation panel 3, a printer portion 4, a document conveyer 5, and a document reader 6.

The main controller 1 controls the operation of the multifunction peripheral 100. The main controller 1 controls different blocks in the multifunction peripheral 100 in jobs such as copying and transmission. The main controller 1 includes a main control circuit 11, an image data generation circuit 12, an image processing circuit 13, and a communication circuit 14. The main controller 1 is, for example, a circuit board (main control board). The main control circuit 11 is, for example, a CPU. The main control circuit 11 performs processing and calculation related to jobs.

Based on an analog image signal that the document reader 6 outputs by reading a document D, the image data generation circuit 12 generates read image data. The image data generation circuit 12 includes a circuit that processes the analog image signal. The image data generation circuit 12 includes, for example, an amplifier circuit, an offset circuit, and an A-D conversion circuit. The A-D conversion circuit converts the analog image signal adjusted by the amplifier circuit and the offset circuit adjust into digital data (image data). The image data generation circuit 12 generates, for example, gray or color read image data.

The image processing circuit 13 performs image processing on the read image data. The image processing circuit 13 is an ASIC (an integrated circuit designed and developed for image processing). For example, in a copy job, the image processing circuit 13 processes the read image data to output print output image data. Based on the print output image data, the main controller 1 makes the printer portion 4 perform printing. The communication circuit 14 includes a communication circuit and a communication memory. The communication memory stores communication software. The communication circuit 14 communicates with a computer 200. The computer 200 is, for example, a PC or a server. The communication circuit 14 can receive print data from the computer 200. Based on the received print data, the main controller 1 makes the printer portion 4 perform printing (print job, facsimile reception and print)

The multifunction peripheral 100 includes, as the storage medium 2, a RAM, a ROM, and a storage. The storage is a HDD or an SSD or both. Based on programs and data stored in the storage medium 2, the main controller 1 controls different blocks.

The operation panel 3 includes a display panel 31, a touch panel 32, and hardware keys 33. The main controller 1 makes the display panel 31 display messages and setting screens. The main controller 1 makes the display panel 31 display operation images as well. The operation images are, for example, buttons, keys, and tabs. Based on the output of the touch panel 32, the main controller 1 recognizes an operated operation image. The hardware keys 33 include a Start key and a numerical keypad. The touch panel 32 and the hardware keys 33 accept setting operations (operations related to jobs) by a user. The operation panel 3 accepts settings made by the user. For example, the operation panel 3 accepts a setting of resolution in document reading. The operation panel 3 also accepts a setting of whether to read in colors or in black and white.

The printer portion 4 includes a sheet feeder 4*a*, a sheet conveyer 4*b*, an image former 4*c*, and a fixer 4*d*. The sheet feeder 4*a* includes a sheet feed cassette and a sheet feed roller. The sheet feed cassette stores sheets. The sheet feed roller feeds out the sheets. In a print job, the main controller 1 makes the sheet feeder 4*a* feed a sheet to the sheet conveyer 4*b*. The sheet conveyer 4*b* includes, for sheet conveyance, a pair of sheet conveying rollers and a sheet conveying motor. The sheet conveying motor rotates the pair of sheet conveying rollers. The pair of sheet conveying rollers conveys the sheet. The main controller 1 makes the sheet conveyer 4*b* convey the sheet.

The image former 4*c* includes, for example, a photosensitive drum, a charging device, an exposure device, a developing device, and a transfer roller. The main controller 1 makes the image former 4*c* form a toner image based on image data. The main controller 1 makes the image former 4*c* transfer the toner image to a conveyed sheet. The fixer 4*d* includes a heater and a fixing rotary member. The heater heats the fixing rotary member. The sheet is conveyed while in contact with the fixing rotary member. Thus the toner image is fixed to the sheet. The main controller 1 makes the fixer 4*d* fix the transferred toner image to the sheet. The sheet conveyer 4*b* discharges the printed sheet out of the multifunction peripheral 100.

(Document Conveyer 5 and Document Reader 6)

Next, with reference to FIGS. 2 and 3, one example of the document conveyer 5 and the document reader 6 according to the embodiment will be described. The document conveyer 5 is also called an automatic document feeding device (ADF, DP). The document conveyer 5 is provided over the document reader 6. The combination of the document conveyer 5 and the document reader 6 is disposed, for example, in an upper part of the multifunction peripheral 100.

Figure 2:
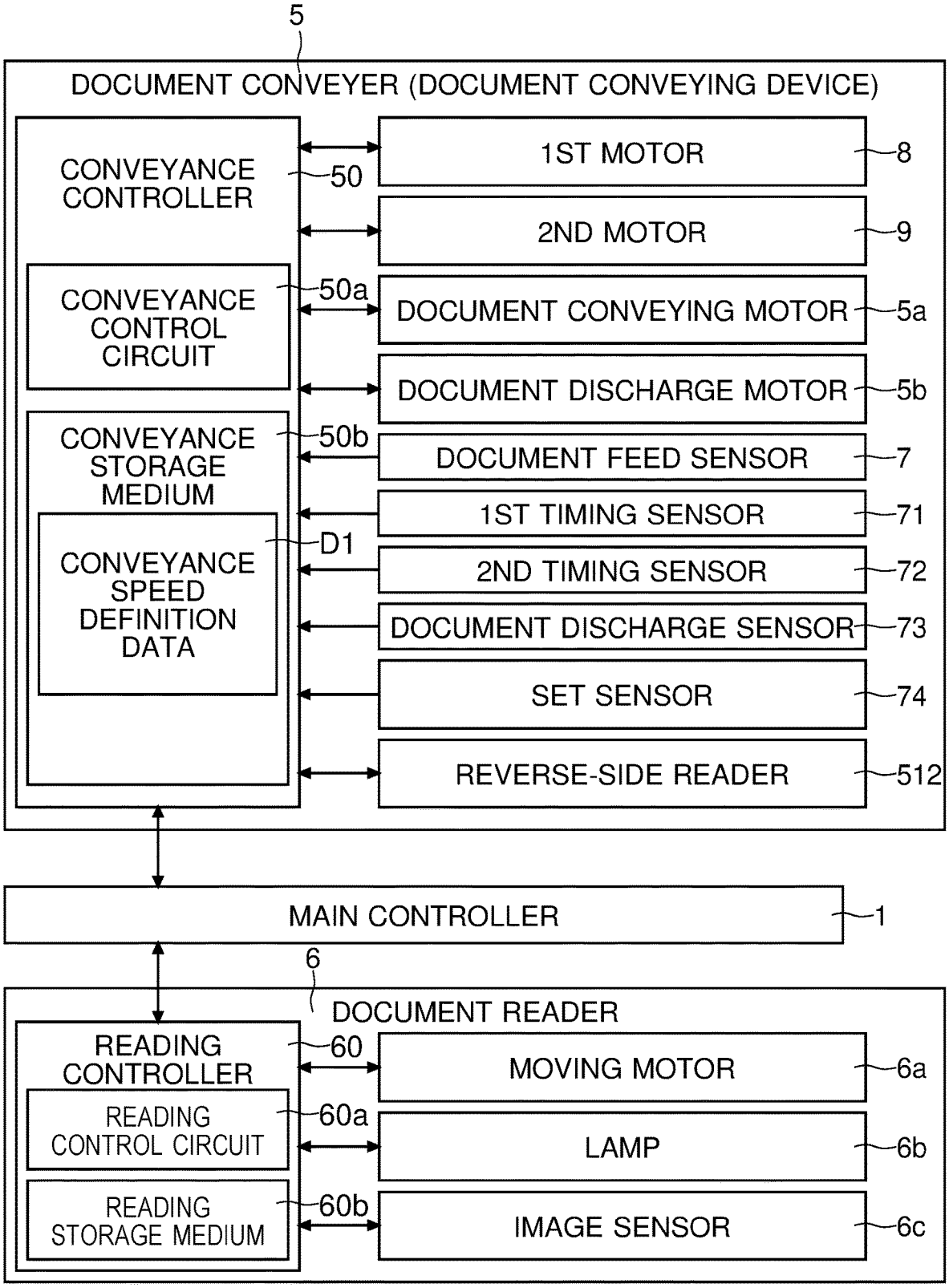
FIG. 2 is a diagram showing one example of a document conveyer and a document reader according to the embodiment.

As shown in FIG. 2, the document conveyer 5 includes a conveyance controller 50 (corresponding to a controller). The conveyance controller 50 is connected to the main controller 1 such that these can communicate with each other. The conveyance controller 50 includes a conveyance control circuit 50*a* and a conveyance storage medium 50*b*. The conveyance control circuit 50*a* is, for example, a CPU. The document conveyer 5 includes, as the conveyance storage medium 50*b*, a ROM and a RAM. The conveyance controller 50 is, for example, a control board that is provided within the document conveyer 5. In a job involving document reading (e.g., a copy job), the main controller 1 instructs the conveyance controller 50 to convey a document. Based on the instruction from the main controller 1, the conveyance controller 50 controls the document conveying operation of the document conveyer 5.

The document reader 6 includes a reading controller 60. The reading controller 60 too is connected to the main controller 1 so that these can communicate with each other. The reading controller 60 includes a reading control circuit 60*a* and a reading storage medium 60*b*. The reading controller 60 is, for example, a CPU. The document reader 6 includes, as the reading storage medium 60*b*, a ROM and a RAM. The reading controller 60 is, for example, a control board provided within the document reader 6. In a job involving document reading, the main controller 1 instructs the reading controller 60 to read a document. Based on the instruction from the main controller 1, the reading controller 60 controls operation for reading the document D. Specifically, the reading controller 60 controls the operation of a moving motor 6*a*, a lamp 6*b*, and an image sensor 6*c* (line sensor).

Figure 3:
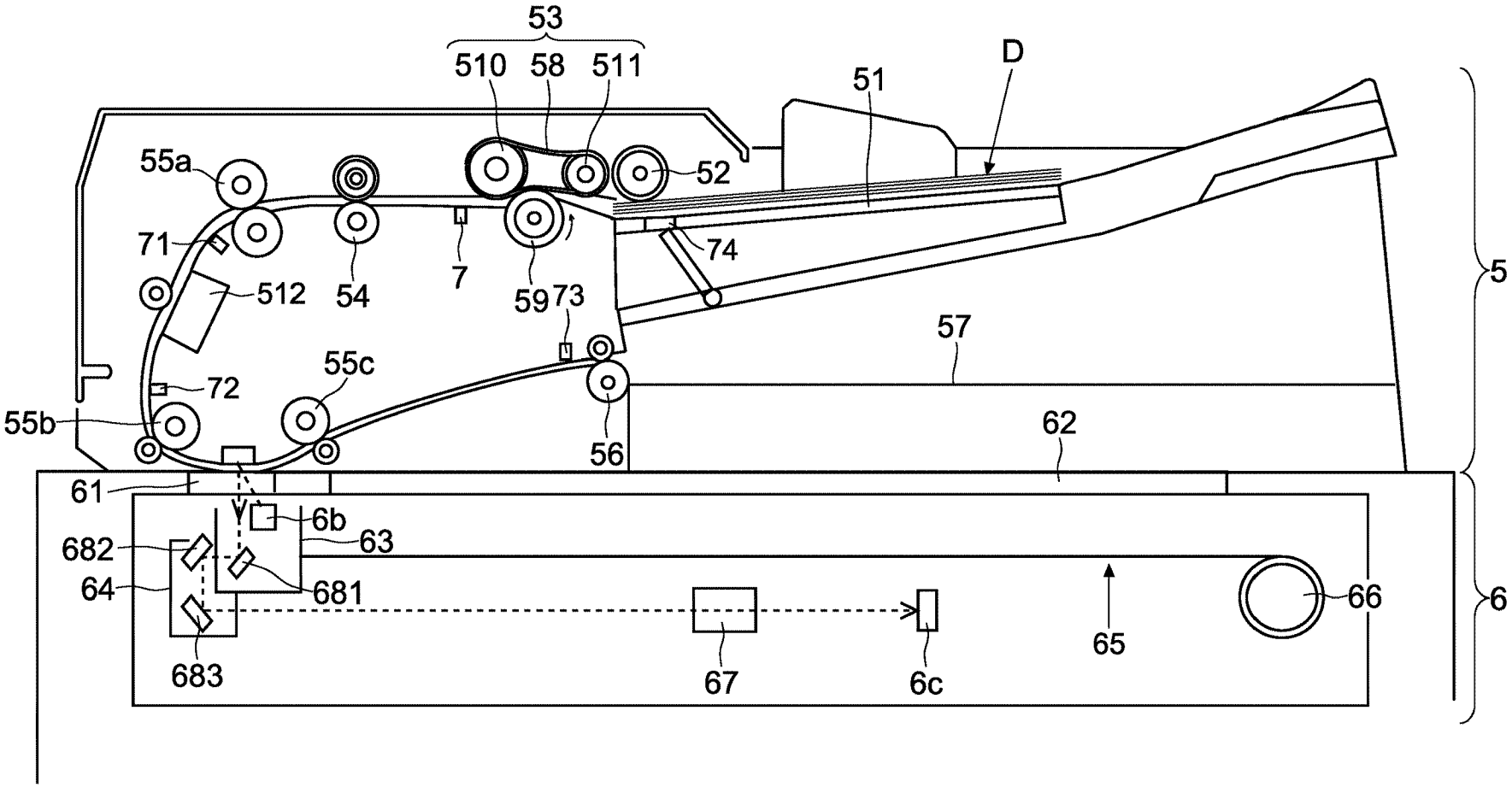
FIG. 3 is a diagram showing one example of the document conveyer and the document reader according to the embodiment.

As shown in FIG. 3, on the top surface of the document reader 6, a feed-reading contact glass 61 and a table-reading contact glass 62 are provided. The document conveyer 5 can be opened and closed in the up-down direction with its end at the front side (near side) of the multifunction peripheral 100 as the free end. To set a document D on the table-reading contact glass 62, the user raises the document conveyer 5. The document conveyer 5 functions as a cover that presses the contact glasses in the document reader 6 from above. On the other hand, when a document D is set on a document tray 51, the document conveyer 5 conveys the document D toward the feed-reading contact glass 61.

As shown in FIG. 3, the document conveyer 5 includes, in order from upstream (from upstream down) in the document conveying direction, a document tray 51, a sheet feed roller 52 (corresponding to a first rotary member), a separating sheet feeder 53 (corresponding to a first rotary member), a document feed sensor 7, a second rotary member 54, a first pair of document conveying rollers 55*a*, a first timing sensor 71, a reverse-side reader 512, a second timing sensor 72, a second pair of document conveying rollers 55*b*, a third pair of document conveying rollers 55*c*, a document discharge sensor 73, a pair of document discharge rollers 56, and a document discharge tray 57. The user sets on the document tray 51 a document D (a bundle of documents) that the user wants to read.

To rotate the different rotary members in the document conveyer 5, the document conveyer 5 includes a first motor 8 (feed motor), a second motor 9 (secondary sheet feed motor), a document conveying motor 5*a*, and a document discharge motor 5*b*. The conveyance controller 50 controls the turning on and off of the rotation of, and the rotation speed of, the first motor 8, the second motor 9, the document conveying motor 5*a*, and the document discharge motor 5*b*.

A set sensor 74 is provided on the document tray 51. The set sensor 74 is a sensor for sensing whether or not a document D is set (placed) on the document tray 51. The output level of the set sensor 74 changes according to whether or not a document D is set. The output of the set sensor 74 is fed to the conveyance controller 50. Based on the output of the set sensor 74, the conveyance controller 50 recognizes whether or not a document D is present on the document tray 51. The conveyance controller 50 notifies the main controller 1 of presence or absence of a document D on the document tray 51. The main control portion 1 recognizes whether or not a document D is set on the document tray 51.

The document conveyer 5 feeds and conveys documents D on the document tray 51 one by one. The document conveyer 5 feeds out the documents D automatically and continuously while securing sheet-to-sheet intervals. The documents D are eventually discharged onto the document discharge tray 57. On the way along a document conveyance passage (between the second pair of document conveying rollers 55*b* and the third pair of document conveying rollers 55*c*), the feed-reading contact glass 61 is located. Over the feed-reading contact glass 61, the reading position is located. In feed-reading, the main controller 1 makes the document reader 6 read an image on a document D that passes across the feed-reading contact glass 61.

The document conveyer 5 includes a first rotary member that feeds out (feeds) documents D set on the document tray 51 one by one. The document conveyer 5 includes, as the first rotary member, the sheet feed roller 52 and the separating sheet feeder 53. The sheet feed roller 52 is provided at a position where it lies in contact with a downstream end part, in the document conveying direction, of the documents D set on the document tray 51. The first motor 8 rotates the sheet feed roller 52. In feed-reading the conveyance controller 50 rotates the first motor 8. The sheet feed roller 52 rotates and feeds a document D out of the document tray 51. The separating sheet feeder 53 includes a sheet feed belt 58, a driving roller 510, a driven roller 511, and a separation roller 59. The sheet feed belt 58 is stretched around the driving roller 510 and the driven roller 511. The sheet feed belt 58 revolves in a direction in which it feeds the document D downstream in the document conveying direction.

The first motor 8 rotates the driving roller 510 as well. Thus the sheet feed belt 58 revolves in a direction in which it feeds the document D downstream in the document conveying direction. The separation roller 59 is provided at a position at which it faces the sheet feed belt 58. It can occur that a plurality of documents D are conveyed in a state overlapped with each other (multiple feeding). The separation roller 59 rotates in a direction in which it feeds a document D back to the document tray 51. If documents D are fed multiply, the separation roller 59 separates them. The lower documents D are fed back in a direction of the document tray 51. The first motor 8 rotates the separation roller 59 as well. The rotary shaft of the separation roller 59 is fitted with a torque limiter. When only one document D is being conveyed, the torque limiter permits the separation roller 59 to rotate in a direction in which it feeds the document D downstream in the document conveying direction.

Between the separating sheet feeder 53 and the second rotary member 54, the document feed sensor 7 is provided. In other words, the document feed sensor 7 is provided downstream of the first rotary member (separating sheet feeder 53) in the document conveying direction, upstream of the second rotary member 54 in the document conveying direction. The document feed sensor 7 is provided, for example, near the outlet of the separating sheet feeder 53. The document feed sensor 7 is for sensing (detecting) the leading end of a document D reaching the document feed sensor 7 and the trailing end of a document D leaving the document feed sensor 7. The document feed sensor 7 is, for example, an optical sensor.

The document feed sensor 7 changes its output level between when sensing and when not sensing the presence of a document D. The output of the document feed sensor 7 is fed to the conveyance controller 50. Based on the output of the document feed sensor 7, the conveyance controller 50 can recognize the leading end (downstream end) of a document D reaching the document feed sensor 7. Based on the output of the document feed sensor 7, the conveyance controller 50 can also recognize a document D being in the middle of passing across the document feed sensor 7. Based on the output of the document feed sensor 7, the conveyance controller 50 can further recognize the trailing end (upstream end) of a document D leaving (having passed across) the document feed sensor 7.

The second rotary member 54 and the pairs of document conveying rollers convey documents D toward the reading position and then toward the document discharge tray 57. The second rotary member 54 is provided downstream of the first rotary member (separating sheet feeder 53) in the document conveying direction. The second rotary member 54 may instead include a pair of rollers. The second motor 9 rotates the second rotary member 54. The document conveying motor 5*a* rotates the pairs of document conveying rollers. Near the exit of a document discharge port (the terminal end of the document conveyer), the pair of document discharge rollers 56 is provided. The pair of document discharge rollers 56 discharges documents D after reading onto the document discharge tray 57. The document discharge motor 5*b* rotates the pair of document discharge rollers 56. During document conveyance, the conveyance controller 50 also rotates the second motor 9, the document conveying motor 5*a*, and the document discharge motor 5*b*.

Between the first pair of document conveying rollers 55*a* and the second pair of document conveying rollers 55*b*, the first timing sensor 71 and the reverse-side reader 512 are provided. The first timing sensor 71 is provided upstream of the reverse-side reader 512 in the document conveying direction. In a two-side reading job, the reverse-side reader 512 reads the reverse side of a conveyed document D. Whether to read only one side (obverse side) or both sides of a document D can be set on the operation panel 3.

The first timing sensor 71 is, for example, an optical sensor. The first timing sensor 71 changes its output level between when sensing and when not sensing the presence of a document D. The output of the first timing sensor 71 is fed to the conveyance controller 50. Based on the output of the first timing sensor 71, the conveyance controller 50 can recognize the leading end of a document D reaching the first timing sensor 71. After the leading end of the document D is recognized reaching the first timing sensor 71, when a previously determined reverse-side time passes, the conveyance controller 50 makes the reverse-side reader 512 start to read the document D. Providing the reverse-side reader 512 makes it possible to read the observe and reverse sides of the document D with a single sequence of conveyance.

The reverse-side reader 512 is a reading unit of a CIS type. The reverse-side reader 512 includes a lamp, a lens, and an image sensor (line sensor). The image sensor in the reverse-side reader 512 outputs an analog image signal. The analog image signal is fed to the image data generation circuit 12. In a job involving reading both sides of a document D, the image data generation circuit 12 generates the read image data of the reverse side of the document D.

As shown in FIG. 3, the document reader 6 includes, inside a housing, a first movable frame 63, a second movable frame 64, a wire 65, a winding drum 66, a lens 67, and an image sensor 6*c*. The first movable frame 63 includes a lamp 6*b* for shining light on the document D as well as a first mirror 681. The second movable frame 64 includes a second mirror 682 and a third mirror 683. The lamp 6*b* is a light source that emits light in the main scanning direction. The lamp 6*b* includes one LED or a plurality of LEDs.

A plurality of wires 65 are fitted to the first and second movable frames 63 and 64. For the sake of convenience, FIG. 3 illustrates only one wire 65. The other end of the wire 65 is connected to the winding drum 66. The moving motor 6*a* rotates the winding drum 66. The moving motor 6*a* can rotate in both forward and reverse directions. It can move the first and second movable frames 63 and 64 freely in the horizontal direction (the sub scanning direction; the left-right direction in FIG. 3). Their movement permits moving the position irradiated by the lamp 6*b*, that is, the position of a reading line.

The operation panel 3 accepts an instruction to start performing a job. When an instruction to start performing a job to read a document D is entered, the main controller 1 checks whether or not a document D is set on the document tray 51. If a document D is set, the main controller 1 makes the document conveyer 5 and the document reader 6 perform feed-reading. Specifically, the main controller 1 makes the document conveyer 5 convey the document D. The main controller 1 makes the document reader 6 read the document D that passes across the feed-reading contact glass 61. In this case, the reading control portion 60 positions the first and second movable frames 63 and 64 under the feed-reading contact glass 61.

If no document D is set on the document tray 51, the main controller 1 makes the document reader 6 read (perform table-reading) a document D set on the table-reading contact glass 62. In this case, the reading controller 60 moves the first and second movable frames 63 and 64 in the sub scanning direction. The main controller 1 does not make the document conveyer 5 convey a document D.

Downstream of the reverse-side reader 512 in the document conveying direction, upstream of the second pair of document conveying rollers 55*b* in the document conveying direction, the second timing sensor 72 is provided. The second timing sensor 72 is, for example, an optical sensor. The second timing sensor 72 changes its output level between when sensing and when not sensing the presence of a document D. The output of the second timing sensor 72 is fed to the conveyance controller 50 and the reading controller 60. Based on the output of the second timing sensor 72, the conveyance controller 50 and the reading controller 60 recognize the leading end of a document D reaching the second timing sensor 72. After the leading end of the document D is recognized reaching the second timing sensor 72, when a previously determined obverse-side time passes, the reading controller 60 makes the image sensor start to read the document D. The obverse-side time is a time commensurate with the conveyance speed of the document D. Using the second timing sensor 72, the reading controller 60 determines when to start reading the obverse side of the document D.

When reading a document D, the reading controller 60 turns on the lamp 6*b*. The lamp 6*b* irradiates the document D with light. Through the mirrors and the lens 67, the light reflected from the document D strikes the image sensor 6*c*. The image sensor 6*c* is a line sensor. The image sensor 6*c* is compatible with color reading. The pixels of the image sensor 6*c* output an analog signal (analog image signal) in accordance with the amounts of light they receive. The analog image signal is fed to the image data generation circuit 12. Based on the analog image signal fed to it, the image data generation circuit 12 generates read image data.

(Registration Mode)

Figure 4:
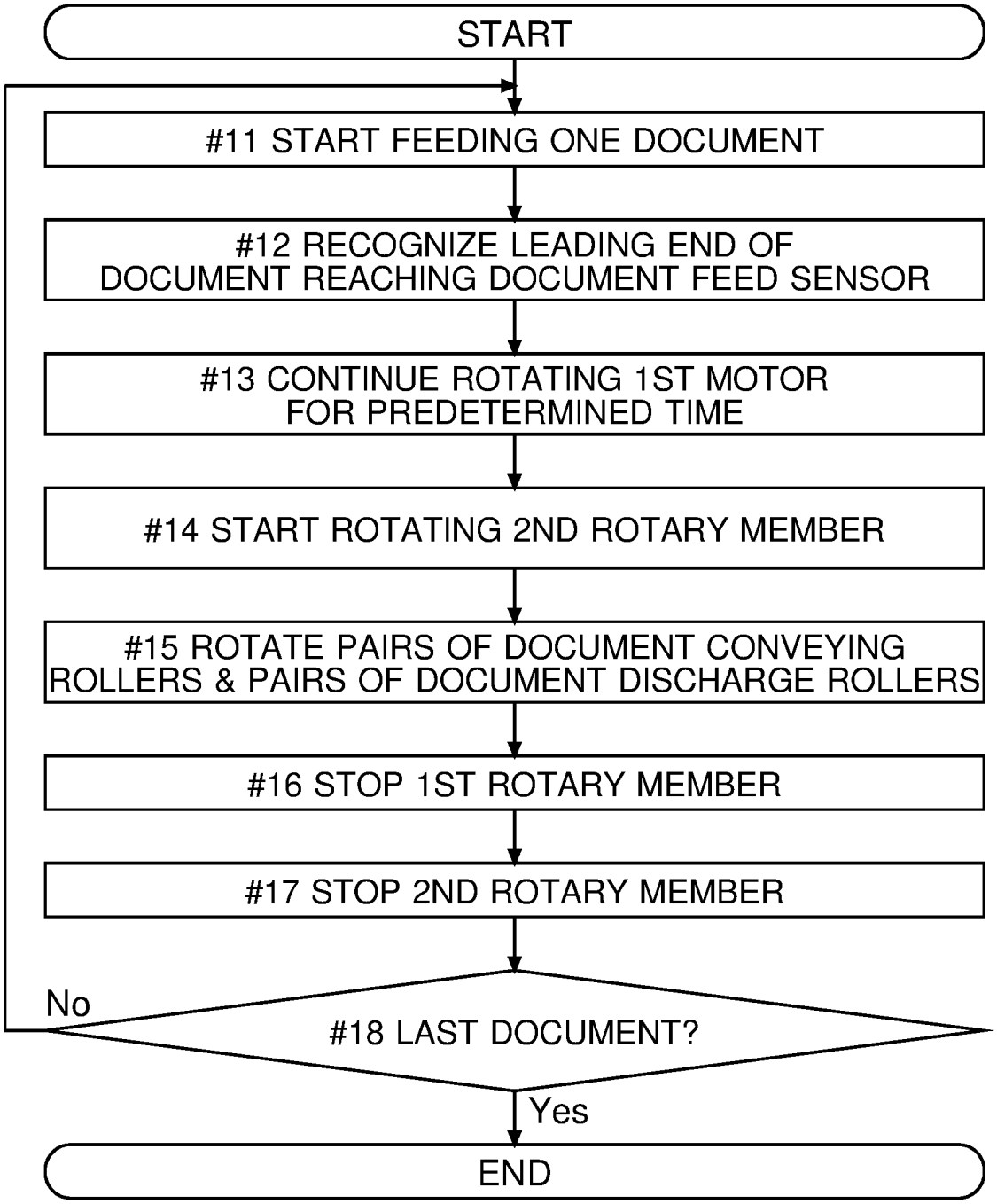
FIG. 4 is a diagram showing one example of document conveyance in a registration mode according to the embodiment.

Next, with reference to FIG. 4, one example of document conveyance in a registration mode according to the embodiment will be described. The multifunction peripheral 100 permits choice between a registration mode and a registrationless mode as modes for feed-reading. The operation panel 3 accepts choice of which of the registration mode and the registrationless mode to use. The user chooses the mode that he or she wants to use in feed-reading.

The registration mode is a mode in which a document D is thrust against the second rotary member 54 to form a sag in the document D and thereby correct skewing of the document D. In other words, it is a mode in which the second rotary member 54 is used as what is generally known as a pair of registration rollers. The conveyed document D temporarily stops. As a result, the number of sheets read per unit time is smaller in the registration mode than in the registrationless mode. Even with a smaller number of sheets read per unit time, a user who wants image data with a smaller skew chooses the registration mode. In contrast, despite occasional skews in image, a user who wants a larger number of sheets read per unit time choses the registrationless mode.

Now, with reference to FIG. 4, one example of a procedure for conveyance of a document D in the registration mode will be described. The procedure of FIG. 4 starts when feed-reading of documents D in the registration mode is started. It is, for example, when the user after setting documents D on the document tray 51 presses the Start button on the operation panel 3.

First the conveyance controller 50 starts to feed one document D (step #11). The conveyance controller 50 rotates the first rotary member (first motor 8). Here the conveyance controller 50 leaves the second rotary member 54 (second motor 9) at rest. Based on the output of the document feed sensor 7, the conveyance controller 50 recognizes the leading end of the document D reaching the document feed sensor 7 (step #12). Having recognized the leading end reaching the document feed sensor 7, the conveyance controller 50 continues to rotate the first motor 8 for a predetermined time (step #13).

The predetermined time is the time required, after the recognition of the leading end reaching the document feed sensor 7, to convey the document D over a skewing correction distance. Let the distance from the document sensing position of the document feed sensor 7 to the nip on the second rotary member 54 be $\alpha$, and let the distance over which a document D is conveyed to make it sag be $\beta$. Then the skewing correction distance equals $\alpha+\beta$. The leading end of the document D (a downstream end part of it in the document conveying direction) conveyed for the predetermined time strikes the second rotary member 54. The elasticity of the document D having a sag formed in it makes its leading end lie along the nip of the second rotary member 54. Thus skewing of the document D is corrected.

After rotating the first motor 8 for the predetermined time, the conveyance controller 50 starts to rotate the second rotary member 54 (step #14). The conveyance controller 50 also rotates the pairs of document conveying rollers and the pair of document discharge rollers 56 (step #15). The conveyance controller 50 rotates those motors such that the document D is conveyed at a predetermined conveyance speed. The conveyance controller 50 may, when starting to convey the first document D, immediately rotate the document conveying motor 5*a* and the document discharge motor 5*b*. Until the last document D is discharged, the conveyance controller 50 continue rotating the document conveying motor 5*a* and the document discharge motor 5*b* (unless a jam occurs).

On the other hand, as for the first motor 8, after the second motor 9 starts to rotate, when a predetermined time passes, the conveyance controller 50 stops the first motor 8 and the first rotary member (the sheet feed roller 52 and the separating sheet feeder 53) (step #16). This is done to prevent a subsequent document D from being fed out immediately after the preceding document D. It is not before the second rotary member 54 starts to draw the document D that the conveyance controller 50 stops the first motor 8. For example, after the second motor 9 starts to rotate, before the trailing end of the document D has passed across the document feed sensor 7, the conveyance controller 50 stops the first motor 8.

Thereafter the conveyance controller 50 stops also the second rotary member 54 and the second motor 9 (step #17). This is done to thrust the subsequent document D against the second rotary member 54. For example, it is not before the conveyance distance after the second rotary member 54 starts to rotate exceeds the distance from the nip of the first pair of document conveying rollers 55*a* to the nip of the second rotary member 54 that the conveyance controller 50 stops the second motor 9. In other words, after the first pair of document conveying rollers 55*a* starts to draw the document D, the conveyance controller 50 stops the second motor 9.

Then the conveyance controller 50 checks whether or not, out of the bundle of documents, the last document D has be fed out (step #18). For example, the conveyance controller 50 checks the output level of the set sensor 74. If the output level is a level indicating absence of a document D, the conveyance controller 50 judges that the last document D has been fed out. If the output level is a level indicating presence of a document D, the conveyance controller 50 judges that the last document D has not been fed out (one or more documents D still remain).

On judging that the last document D has not been fed out (step #18, "No"), the conveyance controller 50 performs step #11 (returns to step #11). On judging that the last document D has been fed out (step #18, "Yes"), the conveyance controller 50 ends the conveyance of documents D ("END"). For example, when the last document D is discharged onto the document discharge tray 57, the conveyance controller 50 stops all the motors.

(Registrationless Mode)

Figure 6:
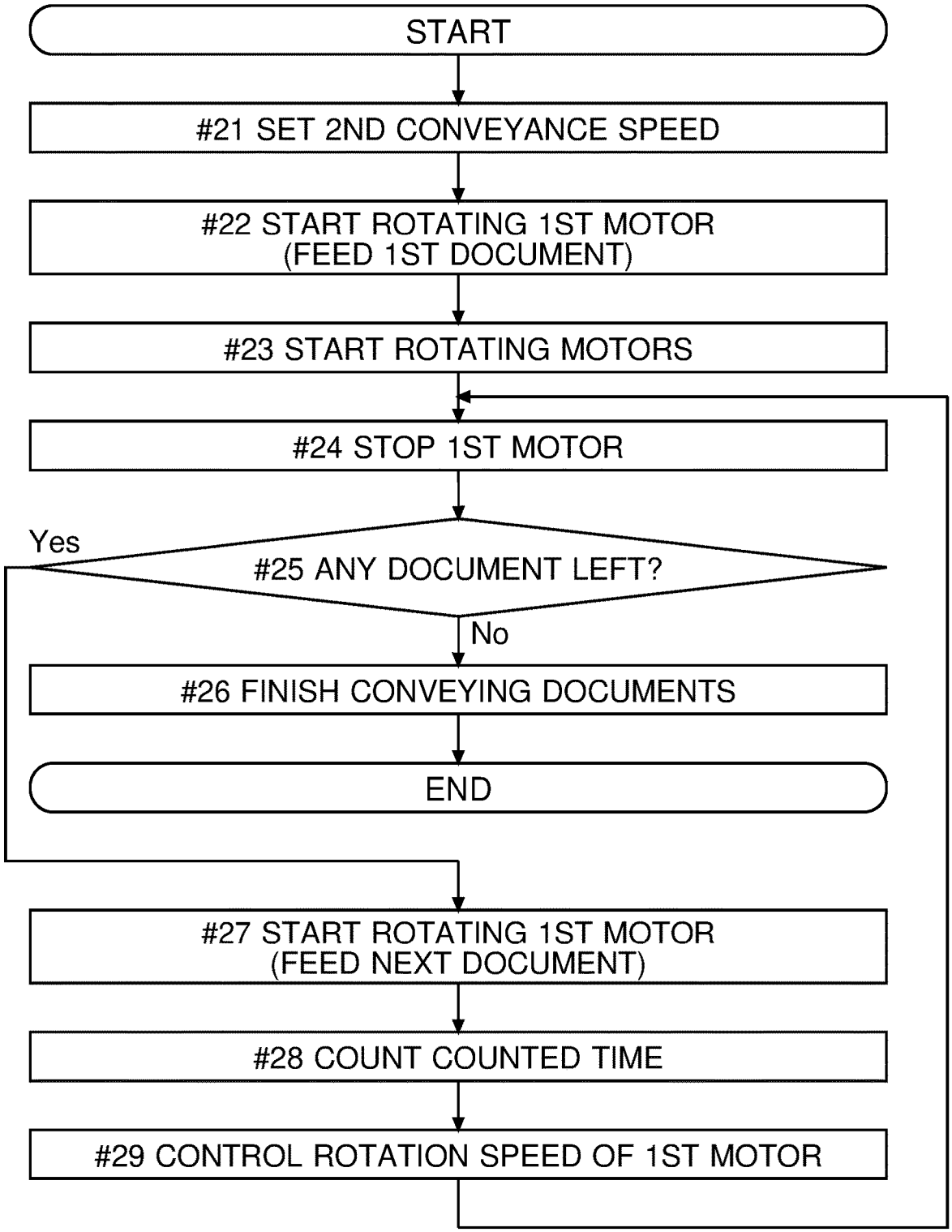
FIG. 6 is a diagram showing one example of document conveyance according to the embodiment.

Next, with reference to FIGS. 5 and 6, the registrationless mode according to the embodiment will be described. The registrationless mode is a mode in which a document D is not thrust against any of the rotary members (the second rotary member 54, the pairs of document conveying rollers, and the pair of document discharge rollers 56) downstream of the first rotary member in the document conveying direction. Except when a set document D protrudes greatly downstream in the document conveying direction, the conveyance controller 50 feeds a document D, once it starts to be fed, to the document discharge tray 57 without stopping the document D. The registrationless mode has the following features.

(Feature 1) No thrusting of a document D against a pair of rollers:

Involving no thrusting of a document D, the registrationless mode can be understood to be a mode in which skewing of a document D is not corrected. The registrationless mode helps save the time for skewing correction. By design, the registrationless mode provides a larger number of sheets read per unit time in feed-reading than the registration mode.

(Feature 2) No momentary stopping of a document D at any rotary member downstream of the first rotary member in the document conveying direction:

No momentary stop means that the conveyance controller 50 can keep rotating the second motor 9 (second rotary member 54), the document conveying motor 5*a* (pairs of document conveying rollers), and the document discharge motor 5*b* (pair of document discharge rollers 56) from the time point that the first document D starts to be conveyed until the time point that the last document D finishes being conveyed. The time point that the first document D starts to be conveyed is when the first motor 8 starts to rotate for the first document D. The time point that the last document D finishes being conveyed is when the document discharge sensor 73 recognizes the trailing end of the last document D leaving it. The registrationless mode is a mode that provides higher productivity than the registration mode.

(Feature 3) Constant intervals between documents D (sheet-to-sheet intervals) through control of the rotation speed of the first motor 8 (first rotary member):

In the registrationless mode, the sheet-to-sheet interval is not controlled with a pair of registration rollers. Instead, the rotation speed of the first motor 8 (first rotary member) is controlled to prevent too short a sheet-to-sheet interval between the document D being fed and the preceding document D.

(Feature 4) Change of the conveyance speed of the first rotary member from a first conveyance speed V1 to a second conveyance speed V2 during the conveying of one document D:

With a document D having reached the second rotary member 54, a difference in conveyance speed between the first rotary member and the second rotary member 54 may cause trouble such as jamming. To avoid that, when the leading end of a document D reaches the second rotary member 54, the conveyance controller 50 changes the rotation speed of the first motor 8 to suit the conveying by the second rotary member 54.

Specifically, in the registrationless mode, during the conveying of one document D, the conveyance controller 50 changes the rotation speed of the first motor 8 from a rotation speed for conveying the document D at the first conveyance speed V1 to a rotation speed for conveying the document D at the second conveyance speed V2. In the following description, the rotation speed of the first motor 8 for conveying a document D at the first conveyance speed V1 will be referred to as the "first rotation speed" and the rotation speed of the first motor 8 for conveying a document D at the second conveyance speed V2 will be referred to as the "second rotation speed".

(Feature 5) Conveying of a document D at the second conveyance speed V2 by the second rotary member 54, the pairs of document conveying rollers, and the pair of document discharge rollers 56: In the registrationless mode, a document D is conveyed at the second conveyance speed V2. Specifically, the conveyance controller 50 rotates the second motor 9 such that the circumferential velocity of the rollers in the second rotary member 54 equals the second conveyance speed V2. The conveyance controller 50 also rotates the document conveying motor 5*a* such that the circumferential velocity of each roller in the pairs of document conveying rollers equals the second conveyance speed V2. The conveyance controller 50 further rotates the document discharge motor 5*b* such that the circumferential velocity of the rollers in the pair of document discharge rollers 56 equals the second conveyance speed V2.

In summary, when documents D set on the document tray 51 are fed out one by one, after the first document D starts to be conveyed unit the last document D finishes being conveyed, the conveyance controller 50 does not thrust a document D against any of the rotary members provided downstream of the first rotary member in the document conveying direction. The conveyance controller 50 keeps rotating the rotary members downstream of the first rotary member in the document conveying direction. The rotary members so kept rotating to convey documents D at the second conveyance speed V2.

The size of the read image data depends on the setting values for reading resolution and color. That is, these setting values affect the amount of data to be generated and processed. Accordingly, in the multifunction peripheral 100, the second conveyance speed V2 varies with the combination of a setting value for reading resolution and a setting values for color/monochrome. Regardless of the combination, the first conveyance speed V1 is previously determined and remains constant (fixed). For example, the conveyance storage medium 50*b* (ROM) stores, on a nonvolatile basis, conveyance speed definition data D1 that defines values of the second conveyance speed V2 corresponding to different resolution and color settings selectable. FIG. 5 is a diagram showing one example of the conveyance speed definition data D1.

The document reader 6 and the reverse-side reader 512 have a plurality of reading resolutions. For example, the document reader 6 and the reverse-side reader 512 can read at either 300 dpi and 600 dpi. The operation panel 3 accepts a setting of reading resolution. Twice a resolution both vertically and horizontally means four times the amount of data. It takes longer to read at 600 dpi than at 300 dpi.

On the other hand, reading in colors generates image data of each of different color components, namely R (red), G (green), and B (blue). Reading in back and white generates gray image data. Because of the larger number of color components, it takes longer to process color image data than to process monochrome image data.

As shown in FIG. 5, in color reading at 300 dpi and monochrome reading at 300 dpi, the second conveyance speed V2 is set at a first speed. In color reading at 600 dpi, the second conveyance speed V2 is set at a second speed. In monochrome reading at 600 dpi, the second conveyance speed V2 is set at a third speed.

The second conveyance speed V2 is determined with consideration given to the amount of image data to be processed and the time to be required to read it. In the document conveyer 5 (multifunction peripheral 100), the different speeds are in the relationship First Speed>First Conveyance Speed V1>Third Speed>Second Speed. The first speed is, for example, about 750 to 800 mm/s. The first conveyance speed V1 is, for example, about 600 to 700 mm/s. The second speed is, for example, about 250 to 350 mm/s. The third speed is, for example, higher than the second speed by about 15 to 150 mm/s. At the second conveyance speed V2, a document D reaches the reading position (the reverse-side reader 512, the feed-reading contact glass 61). The higher the second conveyance speed V2, the higher the productivity.

Next, with reference to FIG. 6, one example of a procedure for document conveyance in the registrationless mode according to the embodiment will be described. The following description with reference to FIG. 6 deals with an example where a plurality of documents D are conveyed and read. The procedure of FIG. 6 starts when an instruction to start a job to convey and read documents D is entered. It is, for example, when the Start button on the operation panel 3 is pressed for a job to convey and read documents D.

First, the conveyance controller 50 sets the second conveyance speed V2 (step #21). For example, the main controller 1 determines the second conveyance speed V2 based on the values set for the job to be performed and based on the conveyance speed definition data D1. The main controller 1 informs the conveyance controller 50 of the determined second conveyance speed V2. The conveyance controller 50 sets the second conveyance speed V2 as informed. The second conveyance speed V2 may be higher or lower than the first conveyance speed V1.

Next, for the feeding of the first document D, the conveyance controller 50 starts to rotate the first motor 8 (step #22). When a document D is the first one, there is no need to consider the interval from a preceding document D. Accordingly, for the first document D, the conveyance controller 50 may keep rotating the first motor 8 at the second rotation speed (the speed for conveying the document D at the second conveyance speed V2).

The conveyance controller 50 also starts to rotate the motors (the second motor 9, the document conveying motor 5*a*, and the document discharge motor 5*b*) other than the first motor 8 (step #23). Until the last document D finishes being conveyed, the conveyance controller 50 rotates the motors at the rotation speed for conveying the document D at the second conveyance speed V2.

The document D fed out passes across the feed-reading contact glass 61. As the document D passes there, the document reader 6 reads it. The conveyance controller 50 has the document D having passed across the feed-reading contact glass 61 discharged onto the document discharge tray 57.

In preparation for the conveying of the subsequent document D, the conveyance controller 50 stops the first motor 8 (step #24). After the leading end of the document D is sensed reaching the document feed sensor 7, when the leading end of the document D reaches the second rotary member 54, the conveyance controller 50 stops the first motor 8. On the other hand, before the conveyance controller 50 senses that the trailing end of the document D leaves the document feed sensor 7, the conveyance controller 50 stops the first motor 8.

The time (feed time) after the leading end of a document D is sensed reaching the document feed sensor 7 until the first motor 8 starts to stop may be determined previously. The conveyance controller 50 may stop the first motor 8 when the conveyance distance of the document D after the leading end of the document D is sensed reaching the document feed sensor 7 becomes equal to the distance from the document feed sensor 7 to the nip of the second rotary member 54 plus a margin.

Based on the output of the set sensor 74, the conveyance controller 50 checks whether or not there is any document D left (step #25). If there is no document D left (step #25, "No"), the conveyance controller 50 finishes conveying documents D (step #26 to "END"). For example, when the last document D is discharged, the conveyance controller 50 stops the second motor 9, the document conveying motor 5*a*, and the document discharge motor 5*b*

If there is any document D left (step #25, "Yes"), the conveyance controller 50 starts to rotate the first motor 8 to start to feed the subsequent document D (step #27). For the second or any succeeding document D, the conveyance controller 50, on recognizing the trailing end of the preceding document D having passed across the document feed sensor 7, starts to feed the subsequent document D. For the second or any succeeding document D, the conveyance controller 50 controls the rotation speed of the first motor 8 finely.

To control the rotation of the first motor 8, the conveyance controller 50 counts, for each document D, the time (counted time T0) after the first motor 8 starts to rotate until the leading end of the document D is recognized reaching the document feed sensor 7 (step #28). Based on the output of the document feed sensor 7, the conveyance controller 50 recognizes the leading end of the document D reaching the document feed sensor 7.

Based on the length of the counted time T0, the conveyance controller 50 controls the rotation speed of the first motor 8 (step #29). For the second or any succeeding document D, the conveyance controller 50 controls the rotation speed of the first motor 8 finely to adjust the sheet-to-sheet interval between a document D that has just started to be fed and the preceding document D (the one sheet previous document D) (details will be given later). The conveyance controller 50 then performs step #24 (returns to step #24). Until no document D is left any longer, the conveyance controller 50 repeats feeding documents D.

During the period in which the counted time T0 is being counted (during the period after the start of sheet feeding until the conveyance controller 50 recognizes the leading end of the document D reaching the document feed sensor 7), the conveyance control portion 50 conveys the document D at a speed equal to or lower than the first conveyance speed V1. The conveyance controller 50 sets the rotation speed of the first motor 8 to be equal to or lower than the first rotation speed (the first rotation speed being a speed that lets the document D be conveyed at the first conveyance speed V1).

For the second or any succeeding document D, after the leading end of a document D is recognized reaching the document feed sensor 7 until it stops, the conveyance controller 50 conveys the document D at a conveyance speed equal to or lower than the second conveyance speed V2. The conveyance controller 50 sets the rotation speed of the first motor 8 to be equal to or lower than the second rotation speed (the second rotation speed being a speed that lets the document D be conveyed at the second conveyance speed V2).

(Controlling First Motor 8)

Next, with reference to FIGS. 7 to 14, one example of rotation control for the first motor 8 in the registrationless mode according to the embodiment will be described. FIGS. 7 to 14 are diagrams showing the one example of rotation control for the first motor 8 in the registrationless mode according to the embodiment. FIGS. 7 to 10 depict an example of control performed when the second conveyance speed V2 is higher than the first conveyance speed V1 (when the second conveyance speed V2 equals the first speed). FIGS. 11 to 14 depict an example of control performed when the second conveyance speed V2 is lower than the first conveyance speed V1 (when the second conveyance speed V2 equals the second or third speed).

The following description deals with an example where a stepping motor is used as the first motor 8. The conveyance controller 50 can, by changing the frequency of a pulse signal (clock signal) that is fed to the stepping motor, change the rotation speed of the first motor 8. If the frequency changes too fast, the first motor 8 goes out of synchronization. In the multifunction peripheral 100, the rate of change of the frequency, that is, the rate of acceleration and deceleration (negative acceleration) with respect to the rotation speed of the stepping motor, are previously determined. The conveyance controller 50 may change the rotation speed of the first motor 8 with a previously determined rate of acceleration and deceleration. That is, the rate of acceleration and the rate of deceleration may have an equal absolute value. The first motor 8 may be accelerated and decelerated by changing its speed with gradients that have an equal absolute value but have opposite, positive and negative, signs.

First, with reference to FIGS. 7 to 10, in the registrationless mode, a description will be given of one example of rotation control for the first motor 8 in a case where a second or any succeeding document D starts to be fed and in addition Second Conveyance Speed V2>First Conveyance Speed V1 (color or monochrome reading at 300 dpi). The following description deals with four patterns.

(Pattern 1)

Condition 1: Required Sheet-to-Sheet Time Interval−Counted Time T0≤Required Speed Change Time T1.

When Condition 1 is met, the conveyance controller 50 performs control according to Pattern 1.

The required sheet-to-sheet time is a time that is previously determined to secure a given or longer interval between documents D. The required sheet-to-sheet time is the time that indicates an interval between documents D. It is previously determined to be, for example, 100 ms based on the specifications (the target value for the number of documents to be read) and the document conveyance speed.

The required speed change time T1 is the time required for speed change from the first rotation speed to the second rotation speed. The required speed change time T1 has a value in the range from several milliseconds to several tens of milliseconds. Since the first and second conveyance speeds V1 and V2 are determined beforehand, the required speed change time T1 in Patterns 1 to 4 can be handled as a constant.

Figure 7:
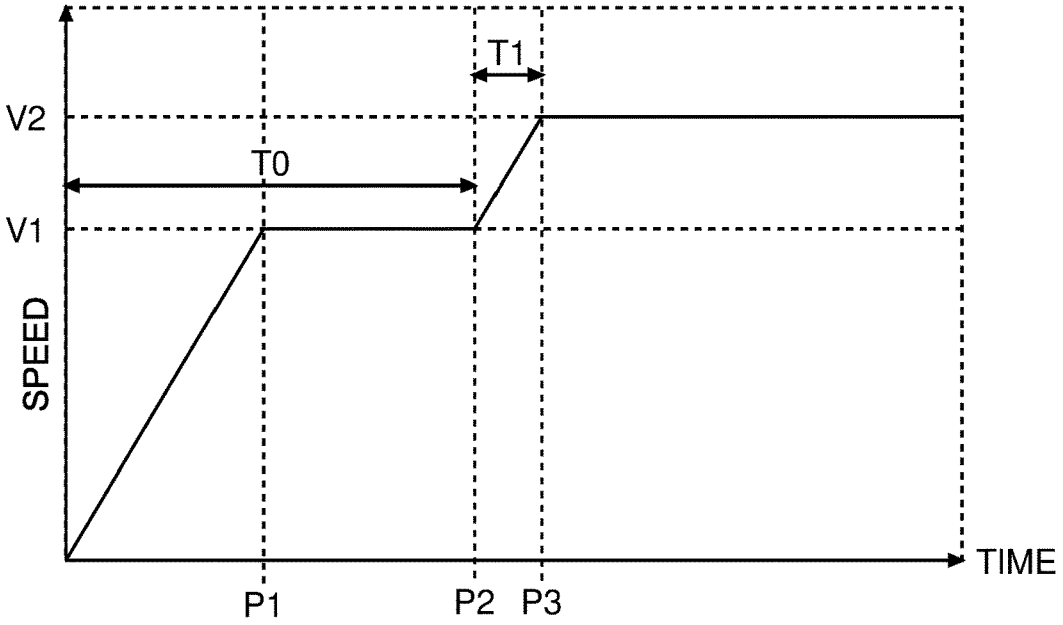
FIG. 7 is a diagram showing one example of rotation control for a first motor according to the embodiment.

FIG. 7 shows one example of rotation speed control for the first motor 8 according to Pattern 1. In FIG. 7, the horizontal axis represents time and the vertical axis represents conveyance speed. The intersection between the vertical and horizontal axes represents the time point of the start of rotation of the first motor 8 (the time point of the start of feeding of the second or any succeeding document D). Specifically, the time point of the start of feeding of the second or any succeeding document D is the time point that, based on the output of the document feed sensor 7, the conveyance controller 50 recognizes the trailing end of the preceding document D having passed across the document feed sensor 7.

When the document D being fed does not protrude downstream in the document conveying direction, the counted time T0 is long. After the document D is conveyed at the first conveyance speed V1 for a certain period of time, the conveyance controller 50 recognize the leading end of the document D reaching the document feed sensor 7. Modifying the formula of Condition 1 gives the formula Required Sheet-to-Sheet Time Interval−Required Speed Change Time T1≤Counted Time T0. When the counted time T0 is long, Condition 1 is met. When the counted time T0 is long, the sheet-to-sheet interval between the document D being fed and the preceding document D (one sheet previous document D) can be regarded as sufficient.

After the start of rotation of the first motor 8, time point P1 in FIG. 7 is the time point that the rotation speed of the first motor 8 reaches the first rotation speed (the time point that the conveyance speed of the document D reaches the first conveyance speed V1). At time point P1, the conveyance controller 50 rotates the first motor 8 constantly at the first rotation speed. Time point P2 is the time point that the conveyance controller 50 recognizes the leading end of the document D reaching the document feed sensor 7. From the vertical axis of FIG. 7 to time point P2 spans the counted time T0.

On recognizing the leading end of the document D reaching the document feed sensor 7, the conveyance controller 50 changes the conveyance speed of the document D. Specifically, the conveyance controller 50 changes the rotation speed of (accelerates) the first motor 8 from the first rotation speed to the second rotation speed. Time point P3 is the time point that the speed change (acceleration) from the first rotation speed to the second rotation speed is completed. Thereafter, the first rotary member conveys the document D at the second conveyance speed V2. Until the first motor 8 stops, the conveyance controller 50 rotates the first motor 8 at a constant speed (starting at time point P3). The interval between time points P2 and P3 is the required speed change time T1.

(Pattern 2)

Condition 2: Required Sheet-to-Sheet Time Interval−Counted Time T0>Required Speed Change Time T1.

Condition 3: Required Sheet-to-Sheet Time Interval−Counted Time T0≤Required Speed Change Time T1+First Required Stop Time T2+First Required Acceleration Time T3.

When Condition 2 is met and in addition Condition 3 is met, the conveyance controller 50 performs control according to Pattern 2.

Figure 9:
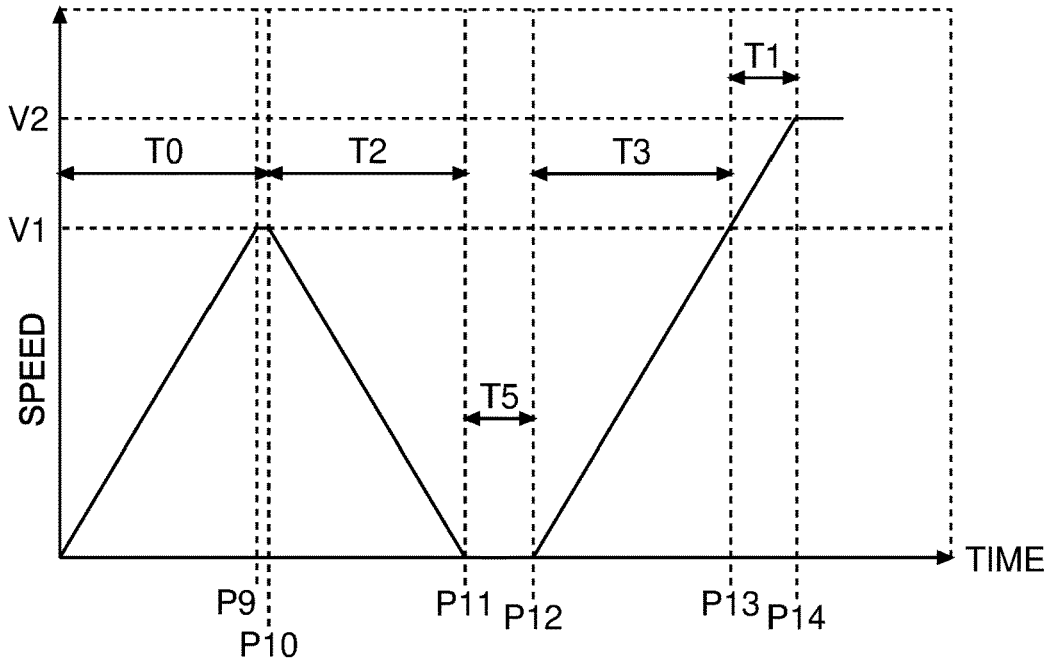
FIG. 9 is a diagram showing one example of rotation control for the first motor according to the embodiment.

The first required stop time T2 is the time required from the first rotation speed until the first motor 8 stops (see FIG. 9). The first required acceleration time T3 is the time required from the start of rotation of the first motor 8 that has stopped rotating until the rotation speed reaches the first rotation speed (see FIG. 9). In the multifunction peripheral 100, the gradient of speed change may have an equal absolute value between during acceleration and during deceleration. Accordingly, the first required stop time T2 and the first required acceleration time T3 may be equal, and may be handled as constants. The first required stop time T2 and the first required acceleration time T3 are, for example, several tens of milliseconds.

When a document D that protrudes slightly downstream in the document conveying direction is fed, the counted time T0 is shorter than in Pattern 1 (FIG. 7). When the Counted Time T0 is shorter than (Required Sheet-to-Sheet Time Interval−Required Speed Change Time T1), Condition 2 is met. When Condition 2 is met, the conveyance controller 50 temporarily decelerates the first motor 8. Then, based on Condition 3, the conveyance controller 50 determines whether or not to stop the first motor 8. When Condition 3 is met, the conveyance controller 50 determines to decelerate but not stop the first motor 8.

Figure 8:
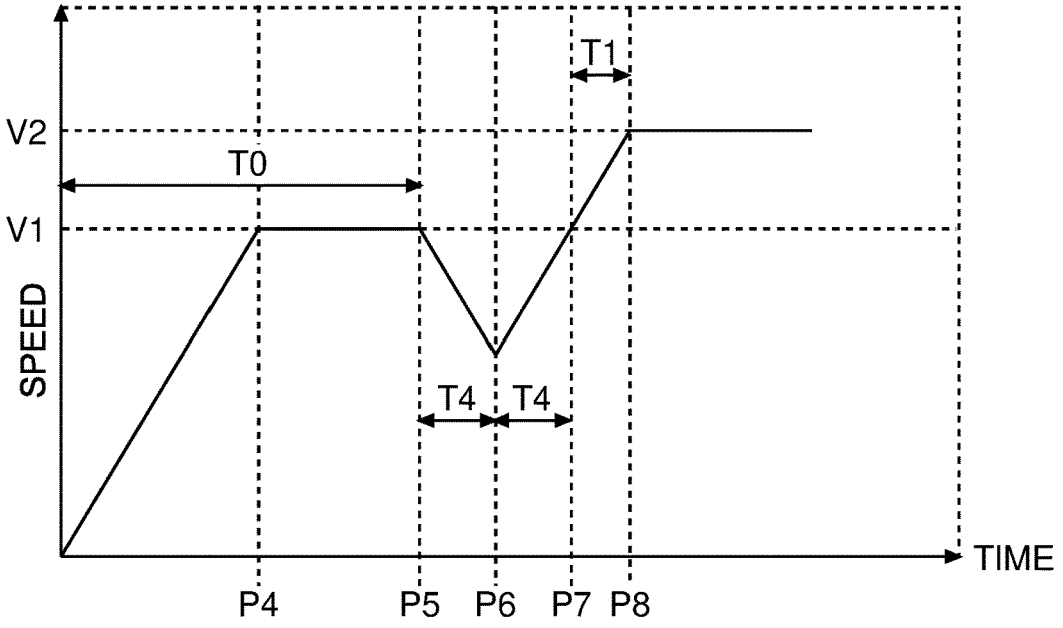
FIG. 8 is a diagram showing one example of rotation control for the first motor according to the embodiment.

With reference to FIG. 8, a description will be given of one example of rotation speed control for the first motor 8 according to Pattern 2. Time point P4 is the time point that, after the start of rotation of the first motor 8, the rotation speed of the first motor 8 reaches the first rotation speed. At time point P4, the conveyance controller 50 rotates the first motor 8 constantly at the first rotation speed.

Time point P5 is the time point that the conveyance controller 50 recognizes the leading end of the document D reaching the document feed sensor 7. The period from the vertical axis of the FIG. 8 to time point P5 is the counted time T0. On recognizing the leading end of the document D reaching the document feed sensor 7, the conveyance controller 50 temporarily decreases the rotation speed of the first motor 8 from the first rotation speed. After deceleration, the conveyance controller 50 increases the rotation speed of the first motor 8 up to the second rotation speed. Time point P5 is the time point of the start of deceleration. Time point P6 is the time point of the end of deceleration and is also the time point of the start of acceleration with respect to the rotation speed of the first motor 8.

Time point P7 is the time point that the rotation speed of the first motor 8 once again reaches the first rotation speed. Time point P8 is the time point that the rotation speed of the first motor 8 reaches the second rotation speed. The interval between time points P7 and P8 is the required speed change time T1. Thereafter, until the first motor 8 stops, the conveyance controller 50 rotates the first motor 8 constantly at the second rotation speed (starting at time point P8).

Based on Formula 1 below, the conveyance controller 50 determines the length of the period T for which to decelerate the first motor 8.

Period $T4$=(Required Sheet-to-Sheet Time Interval−Counted Time $T0$−Required Speed Change Time $T1$)/2 Formula 1:

That is, the conveyance controller 50 calculates one half of the period from time point P5 to time point P7.

The conveyance controller 50 keeps decreasing the rotation speed of the first motor 8 for the calculated time. Then the conveyance control portion 50 restarts acceleration, changing the rotation speed of the first motor 8 back to the first rotation speed over the calculated time (the same time as in deceleration).

Formula 1 in the context of FIG. 8 implies that the period from the start of rotation of the first motor 8 until the rotation speed of the first motor 8 reaches the second rotation speed corresponds to the required sheet-to-sheet time interval. That is, the conveyance controller 50 controls the first motor 8 such that the period from the start of rotation to the time point of the start of constant-speed rotation at the second rotation speed equals the required sheet-to-sheet time interval. It is possible to start to convey each document D at the second conveyance speed V2 after the passage of the required sheet-to-sheet time interval after the start of sheet feeding. It is thus possible to prevent too short a sheet-to-sheet interval.

(Pattern 3)

Condition 4: Required Sheet-to-Sheet Time Interval−Counted Time T0>Required Speed Change Time T1+First Required Stop Time T2+First Required Acceleration Time T3

Condition 5: After the start of rotation of the first motor, the leading end of the document D is recognized reaching the document feed sensor 78 after acceleration up to the first rotation speed.

Here, the required speed change time T1 is defined just as in Pattern 1. The first required stop time T2 and the first required acceleration time T3 are defined just as in Pattern 2.

When a document D protrudes considerably downstream in the document conveying direction, the counted time T0 is still shorter than in Pattern 2. For example, after completing acceleration of the first motor 8 to the first rotation speed, immediately the conveyance controller 50 recognizes the leading end of the document D reaching the document feed sensor 7. The sheet-to-sheet interval between the document D being fed and the preceding document D can be regarded as considerably short. When Condition 5 is met, based on Condition 4, the conveyance controller 50 determines whether or not to rotate the first motor 8. When Condition 4 is met, the conveyance controller 50 determines to temporarily stop the first motor 8.

With reference to FIG. 9, a description will be given of one example of rotation speed control for the first motor 8 according to Pattern 3. Time point P9 is the time point that, after the start of rotation of the first motor 8, the rotation speed of the first motor 8 reaches the first rotation speed. The conveyance controller 50 keeps the rotation speed of the first motor 8 at the first rotation speed. In the example of FIG. 9, however, the time for which the rotation speed is kept is considerably short (the period between time points P9 and P10).

Time point P10 is the time point that the conveyance controller 50 recognizes the leading end of the document D reaching the document feed sensor 7. The period from the vertical axis of FIG. 9 to P10 is the counted time T0. When the counted time T0 meets Condition 4, on recognizing the leading end of the document D reaching the document feed sensor 7, the conveyance controller 50 decreases the rotation speed of the first motor 8 from the first rotation speed. Time point P10 is the time point of the start of deceleration.

The conveyance controller 50 continues deceleration until eventually it stops the first motor 8. Time point P11 is the time point that the first motor 8 stops. After the stop, when a time passes, the conveyance controller 50 accelerates the rotation of the first motor 8 up to the second rotation speed. Time point P12 is the time point that acceleration is started again. Time point P13 is the time point that the first motor 8 once again reaches the first rotation speed. Having restarted acceleration, the conveyance controller 50 changes the rotation speed of the first motor 8 back to the first rotation speed over the calculated time (the same time as in deceleration). In the multifunction peripheral 100, the length of time from time point P10 to time point P11 and the length of time from time point P12 to time point P13 may be equal.

Time point P14 is the time point that the rotation speed of the first motor 8 becomes equal to the second rotation speed. Until the first motor 8 stops, the conveyance controller 50 rotates the first motor 8 constantly at the second rotation speed (starting at time point P14). Between time points P11 and P12, the conveyance controller 50 keeps the first motor 8 at rest.

Based on Formula 2 below, the conveyance controller 50 determines the length of a first stop period T5. The first stop period T5 is the time for which the first motor 8 is kept at rest in Pattern 3.

First Stop Period $T5$=(Required Sheet-to-Sheet Time Interval−Counted Time $T0$−Required Speed Change Time $T1$−First Required Stop Time $T2$−First Required Acceleration Time $T3$). Formula 2:

In FIG. 9, the counted time T0 is the time from the vertical axis to time point P10. The required speed change time T1 is the time from time point P13 to time point P14. The first required stop time T2 is the time from time point P10 to time point P11. The first required acceleration time T3 is the time from time point P12 to time point P13. As mentioned above, the required speed change time T1, the first required stop time T2, and the first required acceleration time T3 can be handled as constants.

In the example of FIG. 9 (Pattern 3), the conveyance controller 50 takes the period from the vertical axis of FIG. 9 to time point P14 as the required sheet-to-sheet time interval. Based on Formula 2, the conveyance controller 50 calculates as the first stop period T5 the time that results from subtracting from the required sheet-to-sheet time interval the counted time T0, the required speed change time T1, the first required stop time T2, and the first required acceleration time T3. Having decelerated and stopped the first motor 8, the conveyance controller 50 keeps the first motor 8 at rest for the first stop period T5. In this way, it is possible to obtain a longer sheet-to-sheet interval. It is possible to start conveyance at the second conveyance speed V2 after the passage of the required sheet-to-sheet time interval after the start of sheet feeding. It is possible to prevent too short a sheet-to-sheet interval.

(Pattern 4)

Condition 6: After the start of rotation, the leading end of a document D is recognized reaching the document feed sensor 7 before the rotation speed of the first motor 8 becomes equal to the first rotation speed.

Among sheets with high friction or sheets that tend to stick together (e.g., glossy sheets), a document D is easily drawn by the preceding document D. When a document D that protrudes greatly downstream in the document conveying direction is fed, the counted time T0 is even shorter than in Pattern 3. For example, after the start of rotation of the first motor 8, immediately the conveyance controller 50 recognizes the leading end reaching the document feed sensor 7. The sheet-to-sheet interval between the document D being fed and the preceding document D can be regarded as too short.

When Condition 6 is met, the conveyance controller 50 stops the first motor 8. In other words, when Condition 6 is met, the conveyance controller 50 determines that the first motor 8 be stopped to secure an adequate sheet-to-sheet interval.

Figure 10:
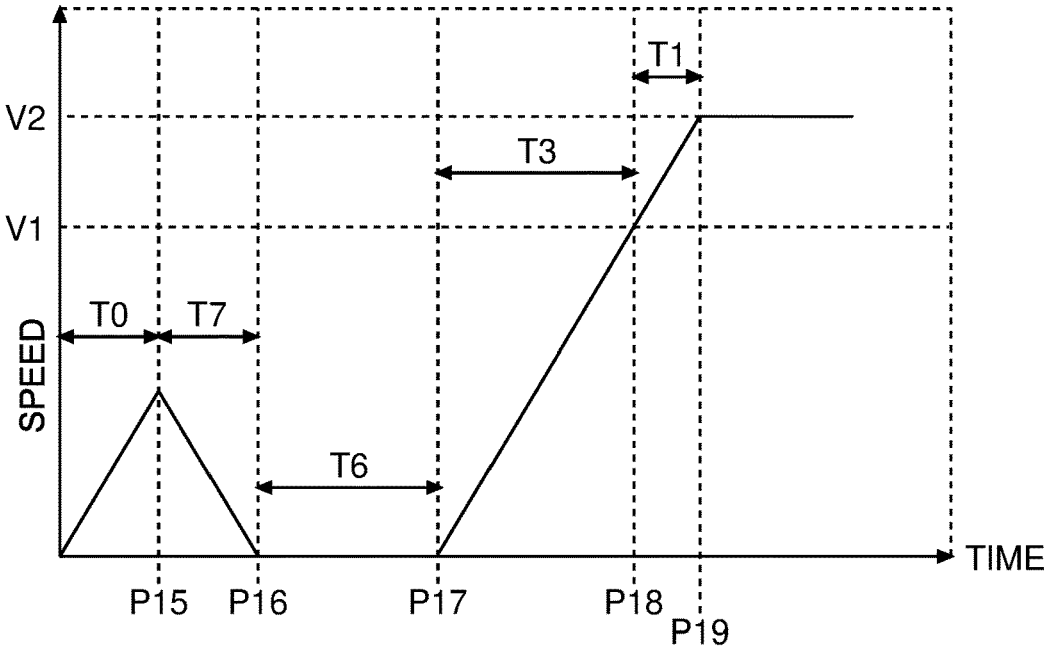
FIG. 10 is a diagram showing one example of rotation control for the first motor according to the embodiment.

With reference to FIG. 10, a description will be given of one example of rotation speed control for the first motor 8 according to Pattern 4. Time point P15 is the time point that the conveyance controller 50 recognizes the leading end of the document D reaching the document feed sensor 7. At time point P15, the first motor 8 has not reached the first rotation speed. Even then, the conveyance controller 50 decreases the rotation speed of the first motor 8. At time point P15, the conveyance controller 50 starts deceleration. The conveyance controller 50 stops the first motor 8. In FIG. 10, time point P16 is the time point that the first motor 8 stops.

After the stop, the conveyance controller 50 increases the rotation speed of the first motor 8 up to the second rotation speed. Time point P17 is the time point that the first motor 8 starts to rotate again. Time point P18 is the time point that the rotation speed of the first motor 8 becomes equal to the first rotation speed. The length of the period between time points P17 and P18 is the first required acceleration time T3. Time point P19 is the time point that the rotation speed of the first motor 8 becomes equal to the second rotation speed. Thereafter, until the first motor 8 stops, the conveyance controller 50 rotates the first motor 8 constantly at the second rotation speed (starting at time point P19).

Between time points P16 and P17 (a first wait time T6), the conveyance controller 50 keeps the first motor 8 at rest. Based on Formula 3 below, the conveyance controller 50 determines the length of the first wait time T6 of the first motor 8. The first wait time T6 is the time for which the first motor 8 is kept at rest in Pattern 4.

First Wait Time $T6$=(Required Sheet-to-Sheet Time Interval−Counted Time $T0$−[the time required after the accelerated first motor 8 starts to decelerate until it stops (*a* time $T7$)]−[the time that the rotation speed of the first motor 8 at rest takes to reach the second rotation speed]. Formula 3:

In FIG. 10, the counted time T0 is the time from the vertical axis to time point P15. The time T7 is the time from time point P15 to time point P16. The conveyance controller 50 may count the time T7 from time point P15 to time point P16. In a case where the rate of acceleration and the rate of deceleration have an equal absolute value, the time T7 is equal to the counted time T0. In this case, the conveyance controller 50 may substitute the counted time T0 for the time T7. The time that the rotation speed of the first motor 8 at rest takes to reach the second rotation speed is the time from time point P17 to time point P19. The period from time point P17 to time point P19 is the sum of the first required acceleration time T3 and the required speed change time T1. The period from time point P17 to time point P19 can be handled as a constant.

That is, in Pattern 4, the period from the vertical axis of FIG. 10 to time point P19 is equal to the required sheet-to-sheet time interval. Based on Formula 3, the conveyance controller 50 calculates the first wait time T6. Having decelerated and stopped the first motor 8, the conveyance controller 50 keeps the first motor 8 at rest for the first wait time T6. In this way, it is possible to obtain a longer sheet-to-sheet interval. It is possible to start conveyance at the second conveyance speed V2 when the required sheet-to-sheet time interval has passed after the start of sheet feeding. It is possible to prevent too short a sheet-to-sheet interval.

Next, with reference to FIGS. 11 to 14, a description will be given of one example of rotation control for the first motor 8 in a case where a second or any succeeding document D starts to be fed and in addition the second conveyance speed V2 is lower than the first conveyance speed V1. Specifically, a description will be given of one example of rotation control for the first motor 8 when the document D is read in colors or in black and white and in addition at a resolution of 600 dpi. The following description deals with four patterns of rotation control for the first motor 8.

(Pattern 5)

Condition 7: Required Sheet-to-Sheet Time Interval−Counted Time T0≤Required Speed Change Time T1.

When Condition 7 is met, the conveyance controller 50 performs control according to Pattern 5.

The required sheet-to-sheet time interval is defined as in Patterns 1 to 4. The required speed change time T1 is the time required for speed change from the first rotation speed to the second rotation speed. Since the second conveyance speed V2 here is different, the required speed change time T1 in Patterns 5 to 8 may be different from the required speed change time T1 in Patterns 1 to 4. In Patterns 5 to 8, the required speed change time T1 is, for example, a value in the range from several milliseconds to several tens of milliseconds. Also in Patterns 5 to 8, the first and second conveyance speeds V1 and V2 are determined beforehand, and thus the required speed change time T1 can be handled as a constant.

Figure 11:
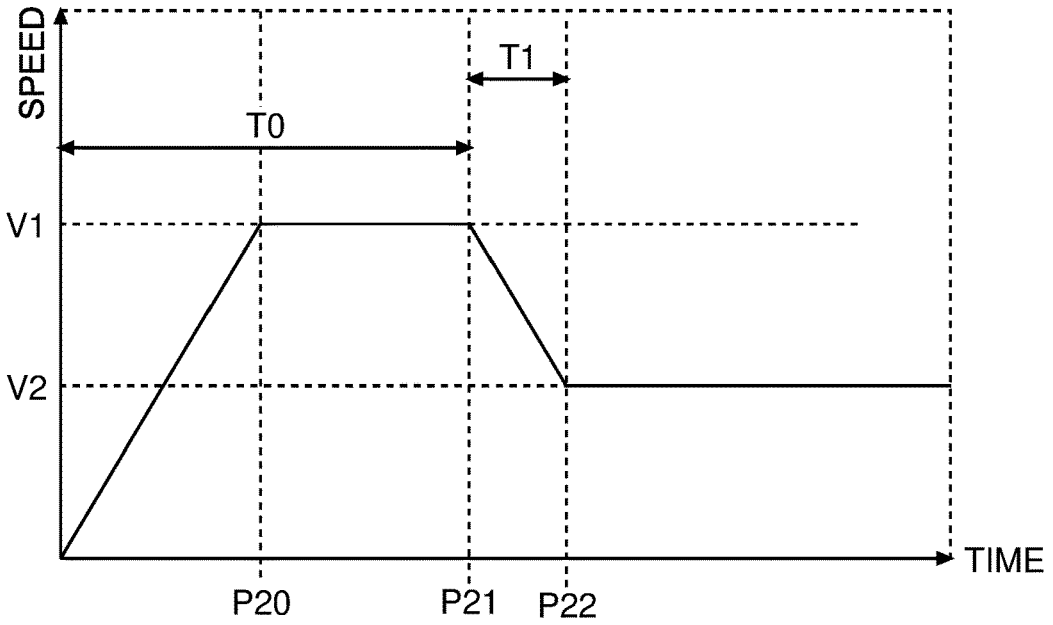
FIG. 11 is a diagram showing one example of rotation control for the first motor according to the embodiment.

FIG. 11 shows one example of rotation speed control for the first motor 8 according to Pattern 5. The intersection between the vertical and horizontal axes represents the time point of the start of rotation of the first motor 8 (the time point of the start of feeding of the second or any succeeding document D). Specifically, on recognizing, based on the output of the document feed sensor 7, the trailing end of the preceding document D having passed across the document feed sensor 7, the conveyance controller 50 starts to rotate the first motor 8.

When the document D being fed protrudes slightly downstream in the document conveying direction, the counted time T0 is long. After the document D is conveyed at the first conveyance speed V1 for a certain period of time, the conveyance controller 50 recognize the leading end of the document D reaching the document feed sensor 7. When the counted time T0 is equal to or longer than (Required Sheet-to-Sheet Time Interval−Required Speed Change Time T1), Condition 7 is met. When the counted time T0 is long, the sheet-to-sheet interval between the preceding document D and the document D being fed can be regarded as sufficient.

With reference to FIG. 11, a description will be given of one example of rotation speed control for the first motor 8 according to Pattern 5. Time point P20 is the time point that, after the start of rotation, the rotation speed of the first motor 8 reaches the first rotation speed. At time point P20, the conveyance controller 50 rotates the first motor 8 constantly at the first rotation speed. In FIG. 11, time point P21 is the time point that the conveyance controller 50 recognizes the leading end of the document D reaching the document feed sensor 7. In FIG. 11, the period from the vertical axis to time point P21 is the counted time T0. On recognizing the leading end of the document D reaching the document feed sensor 7, the conveyance controller 50 changes the rotation speed of (decelerates) the first motor 8 from the first rotation speed up to the second first rotation speed. The conveyance controller 50 changes the conveyance speed of the document D. Time point P22 is the time point that the speed change (deceleration) to the second rotation speed is completed. Until the first motor 8 stops, the conveyance controller 50 rotates the first motor 8 constantly at the second rotation speed (starting at time point P22). The interval between time points P21 and P22 is the required speed change time T1.

(Pattern 6)

Condition 8: Required Sheet-to-Sheet Time Interval−Counted Time T0>Required Speed Change Time T1.

Condition 9: Required Sheet-to-Sheet Time Interval−Counted Time T0≤Required Speed Change Time T1+Second Required Stop Time T8+Second Required Acceleration Time T9.

When Condition 8 is met and in addition Condition 9 is met, the conveyance controller 50 performs control according to Pattern 6.

The second required stop time T8 is the time required from the second rotation speed until the first motor 8 stops. The second required acceleration time T9 is the time required from the start of rotation of the first motor 8 that has stopped rotating until the rotation speed reaches the second rotation speed (see FIG. 13).

In the multifunction peripheral 100, the gradient of speed change may have an equal absolute value between during acceleration and during deceleration. In that case, the second required stop time T8 and the second required acceleration time T9 are equal. In Patterns 5 to 8, the second conveyance speed V2 differs from that in Patterns 1 to 4. Accordingly, the first required stop time T2 and the second required stop time T8 may be different, and the first required acceleration time T3 and the second required acceleration time T9 may be different. For example, the second required stop time T8 and the second required acceleration time T9 are ten and several milliseconds to several tens of milliseconds.

When a document D that protrudes slightly downstream in the document conveying direction is fed, the counted time T0 is shorter than in Pattern 5. Based on Condition 9, the conveyance controller 50 determines whether or not to stop the first motor 8. When Conditions 8 and 9 are met, the conveyance controller 50 determines not to stop the first motor 8.

Figure 12:
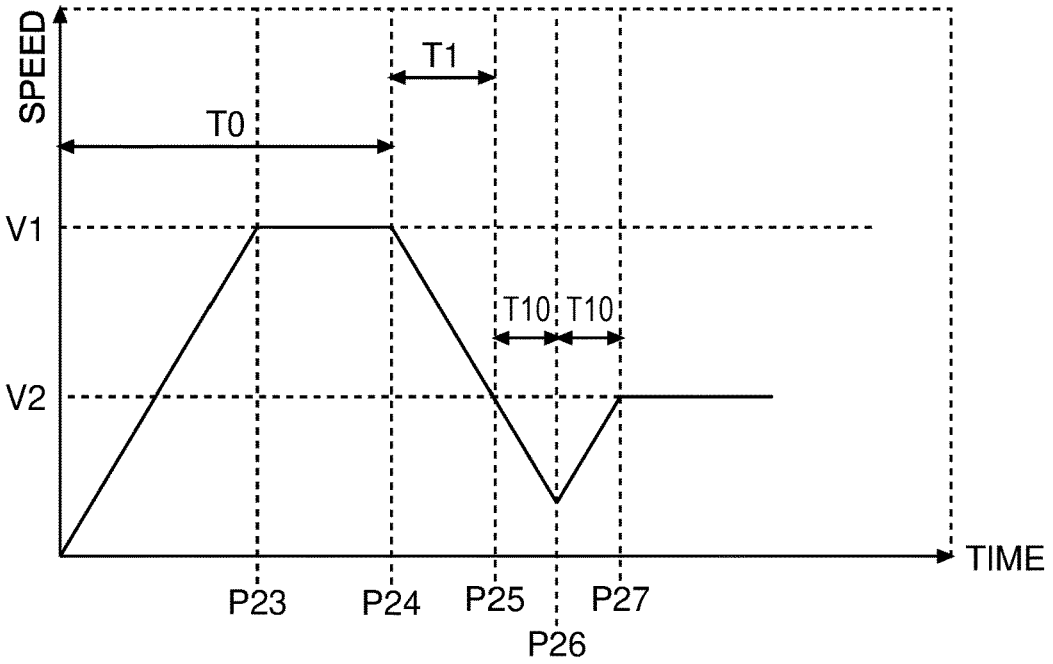
FIG. 12 is a diagram showing one example of rotation control for the first motor according to the embodiment.

With reference to FIG. 12, a description will be given of one example of rotation speed control for the first motor 8 according to Pattern 6. Time point P23 is the time point that, after the start of rotation of the first motor 8, the first motor 8 reaches the first rotation speed. At time point P23, the conveyance controller 50 rotates the first motor 8 constantly at the first rotation speed. Time point P24 is the time point that the conveyance controller 50 recognizes the leading end of the document D reaching the document feed sensor 7. The period from the vertical axis to P24 is the counted time T0. On recognizing the leading end of the document D reaching the document feed sensor 7, the conveyance controller 50 decreases the rotation speed of the first motor 8. After deceleration, the conveyance controller 50 sets the rotation speed of the first motor 8 at the second rotation speed.

Time point P24 is the time point of the start of deceleration. Time point P25 is the time point that, in the process of deceleration, the rotation speed of the first motor 8 is momentarily equal to the second rotation speed. Time point P26 is the time point of the end of deceleration and also of the start of acceleration. Time point P27 is the time point that the rotation speed of the first motor 8 reaches the second rotation speed. Thereafter, until the first motor 8 stops, the conveyance controller 50 rotates the first motor 8 constantly at the second rotation speed (starting at time point P27). In Pattern 6, the time from time point P24 to time point P25 is the required speed change time T1.

Based on Formula 4 below, the conveyance controller 50 determines the length of a deceleration period T10 of the first motor 8.

Deceleration Period $T10$=(Required Sheet-to-Sheet Time Interval−Counted Time $T0$−Required Speed Change Time $T1$)/2. Formula 4:

That is, the conveyance controller 50 calculates one half of the period from time point P25 to time point P27. For the required speed change time T1 plus the calculated time, the conveyance controller 50 keeps decreasing the rotation speed of the first motor 8. The conveyance control portion 50 then restarts acceleration, increasing the rotation speed of the first motor 8 to the second rotation speed over the calculated time T10.

Formula 4 in the context of FIG. 12 implies that, in Pattern 6, the conveyance controller 50 so operates that the time after the first motor 8 starts to rotate until it reaches the second rotation speed is equal to the required sheet-to-sheet time interval. That is, the conveyance controller 50 controls the first motor 8 such that the time from the start of rotation until the start of constant-speed rotation at the second rotation speed is the required sheet-to-sheet time interval. It is possible to start conveyance at the second conveyance speed V2 after the required sheet-to-sheet time interval has passed after the start of sheet feeding. It is possible to prevent too short a sheet-to-sheet interval.

(Pattern 7)

Condition 10: Required Sheet-to-Sheet Time Interval−Counted Time T0>Required Speed Change Time T1+Second Required Stop Time T8+Second Required Acceleration Time T9.

Condition 11: After the start of rotation of the first motor 8, the leading end of the document D is recognized reaching the document feed sensor 7 after acceleration up to the first rotation speed.

Here, the required speed change time T1 is defined just as in Pattern 5. The second required stop time T8 and the second required acceleration time T9 are defined just as in Pattern 6.

When a document D that protrudes considerably downstream in the document conveying direction is fed, the counted time T0 is still shorter than in Pattern 6. For example, after acceleration to the first rotation speed is completed, immediately the conveyance controller 50 recognizes the leading end of the document D reaching the document feed sensor 7. The sheet-to-sheet interval between the document D being fed and the preceding document D can be regarded as considerably short. When Condition 11 is met, based on Condition 10, the conveyance controller 50 determines whether or not to stop the first motor 8. When Condition 10 is met, the conveyance controller 50 determines to temporarily stop the first motor 8. When Condition 10 is met and in addition Condition 11 is met, the conveyance controller 50 performs processing according to Pattern 7.

Figure 13:
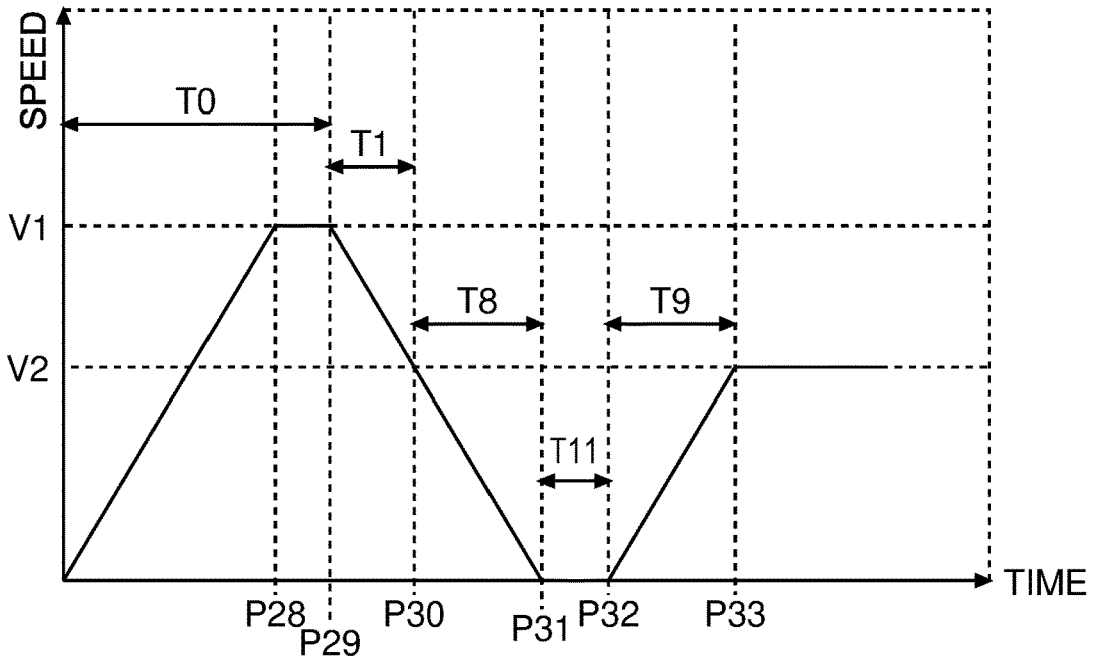
FIG. 13 is a diagram showing one example of rotation control for the first motor according to the embodiment.

With reference to FIG. 13, a description will be given of one example of rotation speed control for the first motor 8 in Pattern 7. Time point P28 is the time point that, after the start of rotation of the first motor 8, the rotation speed of the first motor 8 reaches the first rotation speed. The conveyance controller 50 keeps the rotation speed of the first motor 8 at the first rotation speed. In Pattern 7, however, the time for which the rotation speed is kept is shorter (the period between time points P28 and P29).

Time point P29 is the time point that the conveyance controller 50 recognizes the leading end of the document D reaching the document feed sensor 7. The period from the vertical axis to time point P29 is the counted time T0. When the counted time T0 meets Condition 10, on recognizing the leading end of the document D reaching the document feed sensor 7, the conveyance controller 50 starts decelerating the first motor 8. Time point P29 is the time point of the start of deceleration. The conveyance controller 50 continues deceleration until eventually it stops the first motor 8. Time point P30 is the time point that, in the process of deceleration, the rotation speed of the first motor 8 is momentarily equal to the second rotation speed. Time point P31 is the time point that the first motor 8 stops. After the stop, when a time passes, the conveyance controller 50 increases the rotation speed of the first motor 8 up to the second rotation speed.

Time point P32 is the time point of the start of acceleration. Time point P33 is the time point that the rotation speed of the first motor 8 reaches the second rotation speed. Thereafter, until the first motor 8 stops, the conveyance controller 50 rotates the first motor 8 constantly at the second rotation speed (starting at time point P33). Having restarted acceleration, the conveyance controller 50 changes the rotation speed of the first motor 8 to the second rotation speed over the second required acceleration time T9. The length from time point P30 to time point P31 (second required stop time T8) and the length from time point P32 to time point P33 (second required acceleration time T9) may be equal.

Between time points P31 and p32, the conveyance controller 50 keeps the first motor 8 at rest. Based on Formula 5 below, the conveyance controller 50 determines the length of a second stop period T11 of the first motor 8. The second stop period T11 is the time for which the first motor 8 is kept at rest.

Second Stop Period *T*11=(Required Sheet-to-Sheet Time Interval−Counted Time *T*0−Required Speed Change Time *T*1−Second Required Stop Time *T*8−Second Required Acceleration Time *T*9). Formula 5:

In FIG. 13, the counted time T0 is the time from the vertical axis to time point P29. The required speed change time T1 is the time from time point P29 to time point P30. The second required stop time T8 is the time from time point P30 to time point P31. The second required acceleration time T9 is the time from time point P32 to time point P33. The rate of acceleration and deceleration may be determined beforehand, in which case the required speed change time T1, the second required stop time T8, and the second required acceleration time T9 are constants.

In Pattern 7, the required sheet-to-sheet time interval is equal to the period from the vertical axis of FIG. 13 to time point P33. Based on Formula 5, the conveyance controller 50 calculates as the second stop period T11 the time resulting from subtracting from the required sheet-to-sheet time interval the counted time T0, the required speed change time T1, the second required stop time T8, and the second required acceleration time T9. Having decelerated and stopped the first motor 8, the conveyance controller 50 keeps the first motor 8 at rest for the second stop period T11. It is thus possible to obtain a longer sheet-to-sheet interval. It is possible to start conveyance at the second conveyance speed V2 after the required sheet-to-sheet time interval has passed after the start of sheet feeding. It is possible to prevent too short a sheet-to-sheet interval.

(Pattern 8)

Condition 12: After the start of rotation, the leading end of the document D is recognized reaching the document feed sensor 7 before the rotation speed of the first motor 8 becomes equal to the first rotation speed.

When a document D that protrudes greatly downstream in the document conveying direction is fed, the counted time T0 is even shorter than in Pattern 7. For example, after the start of rotation of the first motor 8, immediately the conveyance controller 50 recognizes the leading end of the document D reaching the document feed sensor 7. The sheet-to-sheet interval between the document D being fed and the preceding document D can be regarded as too short.

Figure 14:
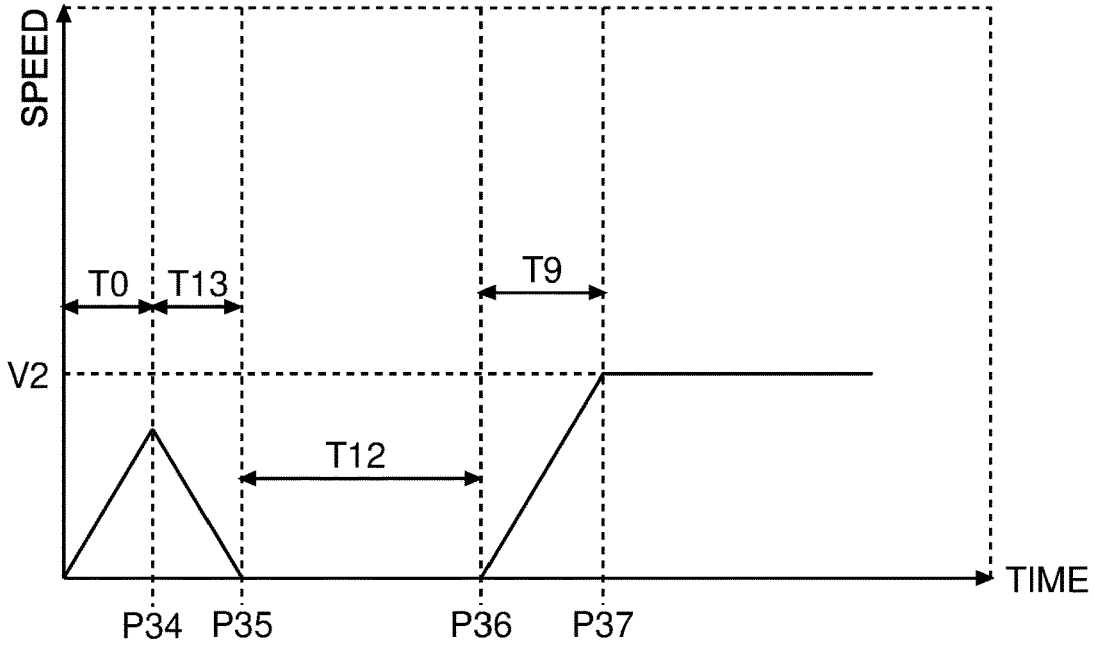
FIG. 14 is a diagram showing one example of rotation control for the first motor according to the embodiment.

When Condition 12 is met, the conveyance controller 50 determines that the first motor 8 should be stopped to secure an adequate sheet-to-sheet interval. With reference to FIG. 14, a description will be given of one example of rotation speed control for the first motor 8 in Pattern 8. Time point P34 is the time point that the conveyance controller 50 recognizes the leading end of the document D reaching the document feed sensor 7. At time point P34, the rotation speed of the first motor 8 has not reached the first rotation speed. In this case, the conveyance controller 50 decelerates the first motor 8. At time point P34, the conveyance controller 50 starts deceleration. The conveyance controller 50 stops the first motor 8. Time point P35 is the time point that the first motor 8 stops.

After the stop, the conveyance controller 50 increases the rotation speed of the first motor 8 up to the second rotation speed. Time point P36 is the time point that first motor 8 starts to rotate again. Time point P37 is the time point that the rotation speed of the first motor 8 becomes equal to the second rotation speed. The interval between time points P36 and P37 is the second required acceleration time T9. Thereafter, until the first motor 8 stops, the conveyance controller 50 rotates the first motor 8 constantly at the second rotation speed (starting at time point P37).

Between time points P35 and P36, the conveyance controller 50 keeps the first motor 8 at rest. Based on Formula 6 below, the conveyance controller 50 determines the length of a second wait time T12. The second wait time T12 is the time for which the first motor 8 is kept at rest in Pattern 8.

Second Wait Time *T*12=(Required Sheet-to-Sheet Time Interval−Counted Time *T*0−[the time required after the accelerated first motor 8 starts to decelerate until it stops (time *T*13)]−Second Required Acceleration Time *T*9). Formula 6:

In FIG. 14, the counted time T0 is the time from the vertical axis to time point P34. The time T13 required after the accelerated first motor 8 starts to decelerate until it stops is the time from time point P34 to time point P35. For example, the conveyance controller 50 may count the time from time point P34 to time point P35. In a case where the rate of acceleration and the rate of deceleration have an equal absolute value, the time T13 is equal to the counted time T0. In this case, the conveyance controller 50 may substitute the counted time T0 for the time T13. The time to reach the second rotation speed from at rest is the time from time point P36 to time point P37. The period from time point P36 to time point P37 is the second required acceleration time T9.

That is, in Pattern 8, the period from the vertical axis of FIG. 14 to time point P37 is equal to the required sheet-to-sheet time interval. Based on Formula 6, the conveyance controller 50 calculates the second wait time T12. Having decelerated and stopped the first motor 8, the conveyance controller 50 keeps the first motor 8 at rest for the second wait time T12. It is thus possible to obtain a longer sheet-to-sheet interval. It is possible to start conveyance at the second conveyance speed V2 when the required sheet-to-sheet time interval has passed after the start of sheet feeding. It is possible to prevent too short a sheet-to-sheet interval.

As described above, according to the present disclosure, a document conveying device (multifunction peripheral 100) includes a document tray 51, a first rotary member (sheet feed roller 52, separating sheet feeder 53), a first motor 8, a second rotary member 54, a second motor 9, a document feed sensor 7, and a controller (conveyance control portion 50). On the document tray 51, a plurality of documents D can be set. The first rotary member feeds one document after another out of the documents D set on the document tray 51. The first motor 8 rotates the first rotary member. The second rotary member 54 is provided downstream of the first rotary member in the document conveying direction, and feeds the document D toward the reading position. The second motor 9 rotates the second rotary member 54 to make it convey the document D at a previously determined second conveyance speed V2. The document feed sensor 7 is provided downstream of the first rotary member in the document conveying direction, upstream of the second rotary member 54 in the document conveying direction. The controller recognizes, based on the output of the document feed sensor 7, the leading end of the document D reaching the document feed sensor 7 and the trailing end of the document D leaving the document feed sensor 7. When the document D starts to be conveyed, the controller starts to rotate (accelerate) the first motor 8. After the first motor 8 starts to rotate until the leading end of the document D reaches the document feed sensor 7, the controller rotates the first motor 8 at a speed equal to or lower than a first rotation speed for conveying the document D at a speed equal to or lower than a previously determined first conveyance speed V1. After the leading end of the document D reaches the document feed sensor 7 until the trailing end of the document D leaves the document feed sensor 7, the controller changes the rotation speed of the first motor 8 to a second rotation speed for conveying the document D at the second conveyance speed V2. After the rotation speed of the first motor 8 reaches the second rotation speed until the subsequent one of the documents D starts to be fed, the controller makes the first motor 8 stop. The controller counts as a counted time T0 the time from the time point of the start of rotation of the first motor 8 until the leading end of the document D reaches the document feed sensor 7. When the time resulting from subtracting the counted time T0 from a previously determined required sheet-to-sheet time interval is longer than a required speed change time T1, the controller performs deceleration and post-deceleration acceleration for the first motor 8 to adjust a sheet-to-sheet interval between the document D being fed and the preceding document D. The required speed change time T1 is the time required for speed change from the first rotation speed to the second rotation speed.

When a bundle of documents is set on the document tray 51 and the documents D are fed continuously, a subsequent document D may be drawn (dragged) by the preceding document D. How easily a document D is drawn depends on a plurality of factors. The factors include paper quality, how a document D is set, and humidity. The farther the subsequent document D protrudes downstream in the document conveying direction, the shorter the counted time T0 during the sheet feeding of the subsequent document D. The counted time T0 can be used to check whether or not the sheet-to-sheet interval is too short.

When the counted time T0 is short, the first motor 8 can be decelerated to intentionally delay the conveying of a document D. It is thus possible to obtain a longer sheet-to-sheet interval between a previous document D and the subsequent document D. In this way, it is possible, without using any rotary member downstream of the first rotary member in the document conveying direction as a pair of registration rollers, to secure a sufficient sheet-to-sheet interval between documents D. Moreover, it is not necessary to thrust a document D against a rotary member (pair of rollers), and thus it is possible to suppress the operating noise of the document conveying device (improved quietness). Also, there is no need to temporarily stop a document D at a pair of registration rollers, and this helps increase the number of documents D conveyed (read) per unit time (enhanced productivity). In addition, even when a document D is not temporarily stopped at a pair of registration rollers, it is possible to secure an adequate sheet-to-sheet interval, and thus to stabilize the number of documents D conveyed per unit time (stable productivity).

(Patterns 1 and 5) Regardless of whether the second conveyance speed V2 is higher than the first conveyance speed V1 or the second conveyance speed V2 is lower than the first conveyance speed V1, if the time resulting from subtracting the counted time T0 from the required sheet-to-sheet time interval is equal to or shorter than the required speed change time T1, the controller accelerates the first motor 8 up to the first rotation speed and then keeps the rotation speed of the first motor 8 at the first rotation speed. On recognizing the leading end of the document D reaching the document feed sensor 7, the controller changes the rotation speed of the first motor 8 to the second rotation speed. Based on the counted time T0, it is possible to determine whether or not a document D that has started to be fed protrudes downstream in the document conveying direction. If the document D is recognized not to protrude downstream in the document conveying direction, it is possible to determine not to perform deceleration. It is possible to prevent too long a sheet-to-sheet interval between documents D.

(Pattern 2) When the second conveyance speed V2 is higher than the first conveyance speed V1, if the time resulting from subtracting the counted time T0 from the required sheet-to-sheet time interval is longer than the required speed change time T1 and in addition the time resulting from subtracting the counted time T0 from the required sheet-to-sheet time interval is equal to or shorter than the sum of the required speed change time T1, a first required stop time T2, and a first required acceleration time T3, then after the first motor 8 starts to rotate, the controller keeps the rotation speed of the first motor 8 having reached the first rotation speed. On recognizing the leading end of the document reaching the document feed sensor 7, the controller decreases the rotation speed of the first motor 8. After the deceleration, the controller increases the rotation speed of the first motor 8 up to the second rotation speed. The first required stop time T2 is the time required from the first rotation speed until the first motor 8 stops. The first required acceleration time T3 is the time required after the start of rotation of the first motor 8 that has stopped rotating until the rotation speed reaches the first rotation speed. Based on the counted time T0, it is possible to determine whether or not the first motor 8 needs to be decelerated to obtain an adequate sheet-to-sheet interval. When the second conveyance speed V2 is higher than the first conveyance speed V1 and in addition a document D is recognized to have started being fed from a slightly protruding position, it is possible to perform deceleration to obtain a longer sheet-to-sheet interval between the document D being fed and the preceding document D. By controlling the rotation speed of the first motor 8, it is possible to achieve an adequate sheet-to-sheet interval between the document D being fed and the preceding document D.

(Pattern 6) When the second conveyance speed V2 is lower than the first conveyance speed V1, if the time resulting from subtracting the counted time T0 from the required sheet-to-sheet time interval is longer than the required speed change time T1 and in addition the time resulting from subtracting the counted time T0 from the required sheet-to-sheet time interval is equal to or shorter than the sum of the required speed change time T1, a second required stop time T8, and a second required acceleration time T9, then after the first motor 8 starts to rotate, the controller keeps the rotation speed of the first motor 8 having reached the first rotation speed. On recognizing the leading end of the document reaching the document feed sensor 7, the controller decreases the rotation speed of the first motor 8. After the deceleration, the controller increases the rotation speed of the first motor 8 up to the second rotation speed.

The second required stop time T8 is the time required from the second rotation speed until the first motor 8 stops. The second required acceleration time T9 is the time required after the start of rotation of the first motor 8 that has stopped rotating until the rotation speed reaches the second rotation speed. Based on the counted time T0, it is possible to determine whether or not the first motor 8 needs to be decelerated to obtain an adequate sheet-to-sheet interval. When the second conveyance speed V2 is lower than the first conveyance speed V1 and in addition a document D is recognized to have started being fed from a position slightly protruding downstream in the document conveying direction, it is possible to perform deceleration to obtain a longer sheet-to-sheet interval between the document D being fed and the preceding document D. By controlling the rotation speed of the first motor 8, it is possible to achieve an adequate sheet-to-sheet interval between the document D being fed and the preceding document D.

The controller may set equal the absolute value of the rate of acceleration and the absolute value of the rate of deceleration for the rotation speed the first motor 8. The controller takes one half of the time resulting from subtracting from the required sheet-to-sheet time interval the counted time T0 and the required speed change time T1 as the time for which to keep decelerating the first motor 8. When the second conveyance speed V2 is higher than the first conveyance speed V1, then after the first motor 8 finishes decelerating, the controller changes the rotation speed of the first motor 8 to the first rotation speed over one half of the time resulting from subtracting from the required sheet-to-sheet time interval the counted time T0 and the required speed change time T1 (Pattern 2). When the second conveyance speed V2 is lower than the first conveyance speed V1, after the first motor 8 finishes decelerating, the controller changes the rotation speed of the first motor 8 to the second rotation speed over one half of the time resulting from subtracting from the required sheet-to-sheet time interval the counted time T0 and the required speed change time T1 (Pattern 6). It is possible to make coincide the time point that an adequate sheet-to-sheet interval is obtained (the time point that the required sheet-to-sheet time interval has passed) with the time point that the conveyance speed becomes equal to the second conveyance speed V2. It is possible, when the adequate sheet-to-sheet interval is obtained, to make equal the conveyance speeds of the document D being fed and the preceding document D. Based on the required sheet-to-sheet time interval, it is possible to determine the time for which to perform deceleration. The document D being fed is conveyed at a speed that is neither too high nor too low with respect to the preceding document D. It is possible to keep the sheet-to-sheet interval between documents D adequate.

(Pattern 3) When the second conveyance speed V2 is higher than the first conveyance speed V1, after the start of rotation, if, after the first motor 8 is accelerated up to the first rotation speed, the leading end of the document is recognized reaching the document feed sensor 7 and in addition the time resulting from subtracting the counted time T0 from the required sheet-to-sheet time interval is longer than the sum of the required speed change time T1, a first required stop time T2, and a first required acceleration time T3, then after the start of rotation, after the first motor 8 is accelerated up to the first rotation speed, the controller keeps the rotation speed of the first motor 8 at the first rotation speed. On recognizing the leading end of the document reaching the document feed sensor 7, the controller decreases the rotation speed of the first motor 8 from the first rotation speed to stop the first motor 8. After the stop, the controller increases the rotation speed of the first motor 8 up to the second rotation speed. The first required stop time T2 is the time required from the first rotation speed until the first motor 8 stops rotating. The first required acceleration time T3 is the time required after the start of rotation of the first motor 8 that has stopped rotating until the rotation speed reaches the first rotation speed. Based on the counted time T0, it is possible to determine whether or not the first motor 8 needs to be temporarily stopped to obtain an adequate sheet-to-sheet interval. When the second conveyance speed V2 is higher than the first conveyance speed V1 and in addition a document D starts to be fed from a position protruding downstream in the document conveying direction, it is possible to perform deceleration and stopping to obtain a longer sheet-to-sheet interval between the document D being fed and the preceding document D. Simply by controlling the rotation speed of the first motor 8, it is possible to achieve an adequate sheet-to-sheet interval between the document D being fed and the preceding document D.

(Pattern 7) When the second conveyance speed V2 is lower than the first conveyance speed V1, after the start of rotation, if, after the first motor 8 is accelerated up to the first rotation speed, the leading end of the document is recognized reaching the document feed sensor 7 and in addition the time resulting from subtracting the counted time T0 from the required sheet-to-sheet time interval is longer than the sum of the required speed change time T1, a second required stop time T8, and a second required acceleration time T9, then after the start of rotation, after the first motor 8 is accelerated up to the first rotation speed, the controller keeps the rotation speed of the first motor 8 at the first rotation speed. On recognizing the leading end of the document reaching the document feed sensor 7, the controller decreases the rotation speed of the first motor 8 from the first rotation speed to stop the first motor 8. After the stop, the controller increases the rotation speed of the first motor 8 up to the second rotation speed. The second required stop time T8 is the time required from the second rotation speed until the first motor 8 stops rotating. The second required acceleration time T9 is the time required after the start of rotation of the first motor 8 that has stopped rotating until the rotation speed reaches the second rotation speed. Based on the counted time T0, it is possible to determine whether or not the first motor 8 needs to be temporarily stopped to obtain an adequate sheet-to-sheet interval. When the second conveyance speed V2 is lower than the first conveyance speed V1 and in addition a document D starts to be fed from a position protruding downstream in the document conveying direction, it is possible to perform deceleration and stopping to obtain a longer sheet-to-sheet interval between the document D being fed and the preceding document D. Simply by controlling the rotation speed of the first motor 8, it is possible to achieve an adequate sheet-to-sheet interval between the document D being fed and the preceding document D.

The controller may set equal the absolute value of the rate of acceleration and the absolute value of the rate of deceleration for the rotation speed the first motor 8. When the second conveyance speed V2 is higher than the first conveyance speed V1, the controller calculates a first stop time T5 by subtracting from the required sheet-to-sheet time interval the counted time T0, the required speed change time T1, the first required stop time T2, and the first required acceleration time T3, and keeps the first motor 8 at rest for the first stop time T5 (Pattern 3). When the second conveyance speed V2 is lower than the first conveyance speed V1, the controller calculates a second stop time T11 by subtracting from the required sheet-to-sheet time interval the counted time T0, the required speed change time T1, the second required stop time T8, and the second required acceleration time T9, and keeps the first motor 8 at rest for the second stop time T11 (Pattern 7). It is possible to make the conveyance speed at the time point that an adequate sheet-to-sheet interval is obtained (at the time point that the required sheet-to-sheet time interval has passed) equal to the second conveyance speed V2. It is possible to determine the stop time of the first motor 8 to obtain an adequate sheet-to-sheet interval. It is possible, when the adequate sheet-to-sheet interval is obtained, to make equal the conveyance speeds of the document D being fed and the preceding document D. It is possible to achieve an adequate sheet-to-sheet interval between documents D.

(Patterns 4 and 8) Regardless of whether the second conveyance speed V2 is higher than the first conveyance speed V1 or the second conveyance speed V2 is lower than the first conveyance speed V1, after the start of rotation, if, before the first motor 8 is accelerated up to the first rotation speed, the leading end of the document is recognized reaching the document feed sensor 7, then after the first motor 8 starts to rotate, on recognizing the leading end of the document reaching the document feed sensor 7, the controller decreases the rotation speed of the first motor 8 to stop the first motor 8. After the stop, the controller increases the rotation speed of the first motor 8 up to the second rotation speed. Based on the counted time T0, it is possible to determine whether or not the sheet-to-sheet interval is so short that the document D is recognized reaching the document feed sensor 7 before the first rotation speed is reached. When a document D is recognized to have started being fed in a state considerably protruding downstream in the document conveying direction, it is possible, by decelerating and stopping the first motor 8 promptly, to greatly increase the sheet-to-sheet interval between the document D being fed and the preceding document D. Simply by controlling the rotation speed of the first motor 8, it is possible to achieve an adequate sheet-to-sheet interval between the document D being fed and the preceding document D.

When the second conveyance speed V2 is higher than the first conveyance speed V1, the controller calculates a first wait time T6 by subtracting the counted time T0, a time required after the first motor 8 having started to rotate until the first motor stops (the time T7 required after the first motor 8 having started to rotate starts to decelerate until the first motor 8 stops), and the time (T1+T3) required from the start of rotation of the first motor 8 that has stopped rotating until the rotation speed reaches the second rotation speed from the required sheet-to-sheet time interval. Having decelerated and stopped the first motor 8, the controller keeps the first motor 8 at rest for the first wait time T6 (Pattern 4). When the second conveyance speed V2 is lower than the first conveyance speed V1, the controller calculates a second wait time T12 by subtracting the counted time T0, a time required after the first motor 8 having started to rotate until the first motor stops (a time T13 required after the first motor 8 having started to rotate starts to decelerate until the first motor 8 stops), and the time T9 required from the start of rotation of the first motor 8 that has stopped rotating until the rotation speed reaches the second rotation speed from the required sheet-to-sheet time interval. Having decelerated and stopped the first motor 8, the controller keeps the first motor 8 at rest for the second wait time T12 (Pattern 8). It is possible to determine the wait time of the first motor 8 (the time for which it is kept at rest) such that the conveyance speed at the time point that an adequate sheet-to-sheet interval is obtained is equal to the second conveyance speed V2. It is possible, when the adequate sheet-to-sheet interval is obtained, to make equal the conveyance speeds of the document D being fed and the preceding document D. The document D being fed is conveyed at a speed that is neither too high nor too low with respect to the preceding document D. It is possible to keep the sheet-to-sheet interval between documents D adequate.

In a job involving reading of a document, the controller determines the second conveyance speed V2 based on a setting for the reading of the document. The second conveyance speed V2 is higher or lower than the first conveyance speed V1. It is possible, without thrusting a sheet against a pair of registration rollers and in addition even when the second conveyance speed V2 is higher or lower than the first conveyance speed V1, to achieve an adequate sheet-to-sheet interval between documents D.

While one document after another is fed out of the documents D set on the document tray 51, after the first of the documents D starts to be conveyed until the last of the documents D finishes being conveyed, the controller does not thrust the document against any rotary member provided downstream of the first rotary member in the document conveying direction, and the controller keeps rotating the rotary member provided downstream of the first rotary member in the document conveying direction at a rotation speed for conveying the document D at the second conveyance speed V2. It is possible to convey a document D without thrusting it against a pair of registration rollers or stopping it temporarily. It is possible to provide, without using a pair of registration rollers, a document conveying device that conveys documents D one by one with an adequate sheet-to-sheet interval.

The embodiments disclosed herein are in every aspect illustrative and not restrictive. The scope of the present disclosure is defined not by the description of the embodiments given above but by the appended claims, and encompasses any modifications made in a sense and scope equivalent to the claims.

What is claimed is:

1. A document conveying device, comprising:

a document tray on which a plurality of documents are set;

a first rotary member that feeds one document after another out of the documents set on the document tray;

a first motor that rotates the first rotary member;

a second rotary member provided downstream of the first rotary member in a document conveying direction, the second rotary member feeding the document toward a reading position;

a second motor that rotates the second rotary member to make the second rotary member convey the document at a previously determined second conveyance speed;

a document feed sensor provided downstream of the first rotary member in the document conveying direction, upstream of the second rotary member in the document conveying direction; and a controller that recognizes, based on an output of the document feed sensor, a leading end of the document reaching the document feed sensor and a trailing end of the document leaving the document feed sensor, wherein when the document starts to be conveyed, the controller starts to rotate the first motor, after the first motor starts to rotate until the leading end of the document reaches the document feed sensor, the controller rotates the first motor at a speed equal to or lower than a first rotation speed for conveying the document at a speed equal to or lower than a previously determined first conveyance speed, after the leading end of the document reaches the document feed sensor until the trailing end of the document leaves the document feed sensor, the controller changes a rotation speed of the first motor to a second rotation speed for conveying the document at the second conveyance speed, after the rotation speed of the first motor reaches the second rotation speed until a subsequent one of the documents starts to be fed, the controller makes the first motor stop, the controller counts as a counted time a time from a time point of the start of rotation of the first motor until the leading end of the document reaches the document feed sensor, when a time resulting from subtracting the counted time from a previously determined required sheet-to-sheet time interval is longer than a required speed change time, the controller performs deceleration and post-deceleration acceleration for the first motor to adjust a sheet-to-sheet interval between the document being fed and a preceding document, and the required speed change time is a time required for speed change from the first rotation speed to the second rotation speed.

2. The document conveying device according to claim 1, wherein regardless of whether the second conveyance speed is higher than the first conveyance speed or the second conveyance speed is lower than the first conveyance speed, if the time resulting from subtracting the counted time from the required sheet-to-sheet time interval is equal to or shorter than the required speed change time, the controller accelerates the first motor up to the first rotation speed and then keeps the rotation speed of the first motor at the first rotation speed, and on recognizing the leading end of the document reaching the document feed sensor, the controller changes the rotation speed of the first motor to the second rotation speed.

3. The document conveying device according to claim 1, wherein when the second conveyance speed is higher than the first conveyance speed, if the time resulting from subtracting the counted time from the required sheet-to-sheet time interval is longer than the required speed change time and in addition the time resulting from subtracting the counted time from the required sheet-to-sheet time interval is equal to or shorter than a sum of the required speed change time, a first required stop time, and a first required acceleration time, after the first motor starts to rotate, the controller keeps the rotation speed of the first motor having reached the first rotation speed, on recognizing the leading end of the document reaching the document feed sensor, the controller decreases the rotation speed of the first motor, after the deceleration, the controller increases the rotation speed of the first motor up to the second rotation speed, the first required stop time is a time required from the first rotation speed until the first motor stops, and the first required acceleration time is a time required after the start of rotation of the first motor that has stopped rotating until the rotation speed reaches the first rotation speed.

4. The document conveying device according to claim 3, wherein the controller sets equal an absolute value of a rate of acceleration and an absolute value of a rate of deceleration for the rotation speed of the first motor, the controller takes one half of a time resulting from subtracting the counted time and the required speed change time from the required sheet-to-sheet time interval as a time for which to keep decelerating the first motor, and when the second conveyance speed is higher than the first conveyance speed, after the first motor finishes decelerating, the controller changes the rotation speed of the first motor to the first rotation speed over one half of the time resulting from subtracting the counted time and the required speed change time from the required sheet-to-sheet time interval.

5. The document conveying device according to claim 1, wherein when the second conveyance speed is lower than the first conveyance speed, if the time resulting from subtracting the counted time from the required sheet-to-sheet time interval is longer than the required speed change time and in addition the time resulting from subtracting the counted time from the required sheet-to-sheet time interval is equal to or shorter than a sum of the required speed change time, a second required stop time, and a second required acceleration time, after the first motor starts to rotate, the controller keeps the rotation speed of the first motor having reached the first rotation speed, on recognizing the leading end of the document reaching the document feed sensor, the controller decreases the rotation speed of the first motor, after the deceleration, the controller increases the rotation speed of the first motor up to the second rotation speed, the second required stop time is a time required from the second rotation speed until the first motor stops, and the second required acceleration time is a time required after the start of rotation of the first motor that has stopped rotating until the rotation speed reaches the second rotation speed.

6. The document conveying device according to claim 5, wherein the controller sets equal an absolute value of a rate of acceleration and an absolute value of a rate of deceleration for the rotation speed of the first motor, the controller takes one half of a time resulting from subtracting the counted time and the required speed change time from the required sheet-to-sheet time interval as a time for which to keep decelerating the first motor, and when the second conveyance speed is lower than the first conveyance speed, after the first motor finishes decelerating, the controller changes the rotation speed of the first motor to the second rotation speed over one half of the time resulting from subtracting the counted time and the required speed change time from the required sheet-to-sheet time interval.

7. The document conveying device according to claim 1, wherein when the second conveyance speed is higher than the first conveyance speed, after the start of rotation, if, after the first motor is accelerated up to the first rotation speed, the leading end of the document is recognized reaching the document feed sensor and in addition the time resulting from subtracting the counted time from the required sheet-to-sheet time interval is longer than a sum of the required speed change time, a first required stop time, and a first required acceleration time, wherein after the start of rotation, after the first motor is accelerated up to the first rotation speed, the controller keeps the rotation speed of the first motor at the first rotation speed, and on recognizing the leading end of the document reaching the document feed sensor, the controller decreases the rotation speed of the first motor from the first rotation speed to stop the first motor, after the stop, the controller increases the rotation speed of the first motor up to the second rotation speed, the first required stop time is a time required from the first rotation speed until the first motor stops rotating, and the first required acceleration time is a time required after the start of rotation of the first motor that has stopped rotating until the rotation speed reaches the first rotation speed.

8. The document conveying device according to claim 1, wherein when the second conveyance speed is lower than the first conveyance speed, after the start of rotation, if, after the first motor is accelerated up to the first rotation speed, the leading end of the document is recognized reaching the document feed sensor and in addition the time resulting from subtracting the counted time from the required sheet-to-sheet time interval is longer than a sum of the required speed change time, a second required stop time, and a second required acceleration time, wherein after the start of rotation, after the first motor is accelerated up to the first rotation speed, the controller keeps the rotation speed of the first motor at the first rotation speed, and on recognizing the leading end of the document reaching the document feed sensor, the controller decreases the rotation speed of the first motor from the first rotation speed to stop the first motor, after the stop, the controller increases the rotation speed of the first motor up to the second rotation speed, the second required stop time is a time required from the second rotation speed until the first motor stops rotating, and the second required acceleration time is a time required after the start of rotation of the first motor that has stopped rotating until the rotation speed reaches the second rotation speed.

9. The document conveying device according to claim 7, wherein the controller sets equal an absolute value of a rate of acceleration and an absolute value of a rate of deceleration for the rotation speed of the first motor, and when the second conveyance speed is higher than the first conveyance speed, the controller calculates a first stop time by subtracting from the required sheet-to-sheet time interval the counted time, the required speed change time, the first required stop time, and the first required acceleration time, and keeps the first motor at rest for the first stop time.

10. The document conveying device according to claim 8, wherein the controller sets equal an absolute value of a rate of acceleration and an absolute value of a rate of deceleration for the rotation speed of the first motor, and when the second conveyance speed is lower than the first conveyance speed, the controller calculates a second stop time by subtracting from the required sheet-to-sheet time interval the counted time, the required speed change time, the second required stop time, and the second required acceleration time, and keeps the first motor at rest for the second stop time.

11. The document conveying device according to claim 1, wherein regardless of whether the second conveyance speed is higher than the first conveyance speed or the second conveyance speed is lower than the first conveyance speed, after the start of rotation, if, before the first motor is accelerated up to the first rotation speed, the leading end of the document is recognized reaching the document feed sensor, then after the first motor starts to rotate, on recognizing the leading end of the document reaching the document feed sensor, the controller decreases the rotation speed of the first motor to stop the first motor, and after the stop, the controller increases the rotation speed of the first motor up to the second rotation speed.

12. The document conveying device according to claim 11, wherein when the second conveyance speed is higher than the first conveyance speed, the controller calculates a first wait time by subtracting the counted time, a time required after the first motor having started to rotate until the first motor stops, and a time required from the start of rotation of the first motor that has stopped rotating until the rotation speed reaches the second rotation speed from the required sheet-to-sheet time interval, and having decelerated and stopped the first motor, the controller keeps the first motor at rest for the first wait time.

13. The document conveying device according to claim 11, wherein when the second conveyance speed is lower than the first conveyance speed, the controller calculates a second wait time by subtracting the counted time, a time required after the first motor having started to rotate until the first motor stops, and a time required from the start of rotation of the first motor that has stopped rotating until the rotation speed reaches the second rotation speed from the required sheet-to-sheet time interval, and having decelerated and stopped the first motor, the controller keeps the first motor at rest for the second wait time.

14. The document conveying device according to claim 1, wherein in a job involving reading of a document, the controller determines the second conveyance speed based on a setting for the reading of the document, and the second conveyance speed is higher or lower than the first conveyance speed.

15. The document conveying device according to claim 1, wherein while one document after another is fed out of the documents set on the document tray, after a first of the documents starts to be conveyed until a last of the documents finishes being conveyed, the controller does not thrust the document against any rotary member provided downstream of the first rotary member in the document conveying direction, and the controller keeps rotating the rotary member provided downstream of the first rotary member in the document conveying direction at a rotation speed for conveying the document at the second conveyance speed.

16. A method of controlling a document conveying device, the method comprising:

setting a plurality of documents on a document tray;

feeding, with a first rotary member, one document after another out of the documents set on the document tray;

rotating, with a first motor, the first rotary member;

feeding, with a second rotary member provided downstream of the first rotary member in a document conveying direction, the document toward a reading position;

rotating, with a second motor, the second rotary member so that the second rotary member conveys the document at a previously determined second conveyance speed;

providing a document feed sensor downstream of the first rotary member in the document conveying direction, upstream of the second rotary member in the document conveying direction;

recognizing, based on an output of the document feed sensor, a leading end of the document reaching the document feed sensor and a trailing end of the document leaving the document feed sensor;

starting, when the document starts to be conveyed, to rotate the first motor;

rotating, after the first motor starts to rotate until the leading end of the document reaches the document feed sensor, the first motor at a speed equal to or lower than a first rotation speed for conveying the document at a speed equal to or lower than a previously determined first conveyance speed;

changing, after the leading end of the document reaches the document feed sensor until the trailing end of the document leaves the document feed sensor, a rotation speed of the first motor to a second rotation speed for conveying the document at the second conveyance speed;

making, after the rotation speed of the first motor reaches the second rotation speed until a subsequent one of the documents starts to be fed, the first motor stop;

counting as a counted time a time from a time point of the start of rotation of the first motor until the leading end of the document reaches the document feed sensor;

performing, when a time resulting from subtracting the counted time from a previously determined required sheet-to-sheet time interval is longer than a required speed change time, deceleration and post-deceleration acceleration for the first motor to adjust a sheet-to-sheet interval between the document being fed and a preceding document; and the required speed change time being a time required for speed change from the first rotation speed to the second rotation speed.

* * * * *